US011417301B2

(12) United States Patent
Stanley et al.

(10) Patent No.: US 11,417,301 B2
(45) Date of Patent: Aug. 16, 2022

(54) PEDAL BOARD AND SYSTEM

(71) Applicant: Alicia Harvey Stanley, Gaithersburg, MD (US)

(72) Inventors: Alicia Harvey Stanley, Gaithersburg, MD (US); Briar D. Robinson, Gaithersburg, MD (US); Robert Walter Kenny, Jr., Mount Airy, MD (US); Exus D. Altimus, Manassas, VA (US); William B. Harvey, Laytonsville, MD (US)

(73) Assignee: Alicia Harvey Stanley, Gaithersburg, MD (US)

( * ) Notice: Subject to any disclaimer, the term of this patent is extended or adjusted under 35 U.S.C. 154(b) by 0 days.

(21) Appl. No.: 16/942,242

(22) Filed: Jul. 29, 2020

(65) Prior Publication Data

US 2020/0372880 A1 Nov. 26, 2020

Related U.S. Application Data

(60) Provisional application No. 62/852,814, filed on May 24, 2019.

(51) Int. Cl.

| | |
|---|---|
| ***G10G 5/00*** | (2006.01) |
| ***G10G 7/00*** | (2006.01) |
| ***G10H 1/34*** | (2006.01) |

(52) U.S. Cl.

CPC ..... *G10G 5/00* (2013.01); *G10G 7/00* (2013.01); *G10H 1/348* (2013.01); *G10H 2210/155* (2013.01); *G10H 2220/071* (2013.01)

(58) Field of Classification Search

CPC ..... G10G 5/00; G10G 7/00; G10H 2210/161; G10H 1/348; G10H 2210/155; G10H 2220/071

See application file for complete search history.

(56) References Cited

U.S. PATENT DOCUMENTS

| | | | |
|---|---|---|---|
| D200,099 | S | 1/1965 | Attwood |
| D233,293 | S | 10/1974 | Rosen |
| D244,748 | S | 6/1977 | Canterbury |
| 4,151,774 | A | 5/1979 | Klann |
| D257,663 | S | 12/1980 | McKee |

(Continued)

FOREIGN PATENT DOCUMENTS

| | | |
|---|---|---|
| GB | 2544517 | 5/2017 |
| KR | 101917599 | 11/2018 |

OTHER PUBLICATIONS

Accel Audio Pedalboards, https://www.accelaudio.com/pedalboards (Last updated Mar. 20, 2019).

(Continued)

*Primary Examiner* — Jianchun Qin

(74) *Attorney, Agent, or Firm* — Lieberman & Brandsdorfer, LLC

(57) ABSTRACT

The embodiments described herein relates to the field of musical instrumentation and associated equipment. More specifically, the embodiments pertain to a pedal board and system that manages equipment associated with electric guitars as well as other musical instruments, namely foot-controlled and floor-located devices, such as special effect devices and foot pedals. The pedal board of the embodiments provides external viewability of the equipment and can include an illuminated display assembly.

12 Claims, 25 Drawing Sheets

(56) References Cited

U.S. PATENT DOCUMENTS

| | | | | |
|---|---|---|---|---|
| D342,011 | S | 12/1993 | Maguire | |
| D402,534 | S | 12/1998 | McCoy et al. | |
| 6,215,055 | B1 * | 4/2001 | Saravis | G10H 1/348 84/422.1 |
| 6,459,023 | B1 | 10/2002 | Chandler | |
| 6,538,185 | B1 | 3/2003 | Stratton | |
| D513,171 | S | 12/2005 | Richardson | |
| 7,485,792 | B2 | 2/2009 | Collins, Sr. | |
| D600,535 | S | 9/2009 | Rix | |
| D625,484 | S | 10/2010 | Savard et al. | |
| 8,614,385 | B2 | 12/2013 | McKinney et al. | |
| 8,802,961 | B2 * | 8/2014 | Juszkiewicz | G10H 1/34 84/746 |
| 9,401,133 | B2 | 7/2016 | McGinly | |
| D769,364 | S | 10/2016 | Trifilio | |
| D781,954 | S | 3/2017 | Wilfer | |
| 9,620,094 | B2 | 4/2017 | Abbate | |
| 9,659,553 | B1 * | 5/2017 | Lawrence | G10H 1/348 |
| 9,691,369 | B2 | 6/2017 | Trifilio | |
| D792,503 | S | 7/2017 | Helweg | |
| D795,334 | S | 8/2017 | Kreifeldt et al. | |
| D815,682 | S | 4/2018 | Trifilio et al. | |
| D820,904 | S | 6/2018 | Fiden et al. | |
| 9,997,149 | B2 | 6/2018 | Trifilio | |
| 10,008,192 | B2 | 6/2018 | Kreifeldt et al. | |
| D821,851 | S | 7/2018 | Stahl et al. | |
| 10,151,464 | B2 * | 12/2018 | Ahern | F21S 6/00 |
| D838,575 | S * | 1/2019 | Helweg | D8/354 |
| 10,204,609 | B2 | 2/2019 | Grifols | |
| D862,578 | S | 10/2019 | Lackner et al. | |
| D862,579 | S | 10/2019 | Lackner et al. | |
| D862,582 | S | 10/2019 | Lackner et al. | |
| D862,583 | S | 10/2019 | Lackner et al. | |
| D874,250 | S | 2/2020 | Stoops | |
| D901,404 | S | 11/2020 | Ice et al. | |
| D907,692 | S | 1/2021 | Wilfer et al. | |
| 2004/0250673 | A1 | 12/2004 | Salerno | |
| 2017/0140744 | A1 * | 5/2017 | Kreifeldt | G10H 1/348 |

OTHER PUBLICATIONS

Blackbird Pedalboards, 1224 Tolex Series with ATA Case, https://blackbirdpedalboards.com/product/1224-tolex-series-with-ata-case/ (YouTube video dated Oct. 3, 2017).

Boss BCB-60 Pedalboard, https://www.boss.info/us/products/bcb-60/ (Last updated Jan. 2019).

Creation Music Company Pedalboards, https://creationmusiccompany.com/ (Last updated Jan. 2019).

HoleyBoard Pedalboard, https://holeyboardpedalboards.com/ (YouTube video dated Apr. 24, 2020).

Pedaltrain Classic 2 with Tour Case, https://pedaltrain.com/products/pt-cl2-tc (Viewed on Feb. 22, 2019).

Salvage Custom Pedalboard, https://reverb.com/item/5640617-salvage-custom-pedalboard (Listed for Sale 2017).

Schmidt Array Taurus Pedalboards, https://www.schmidtarray.com/shop-6 (Last updated Dec. 2017).

Trailer Trash Pedalboards, http://trailertrashpedalboards.com/the-boards (Last updated Dec. 2019).

Voodoo Lab Dingbat Pedalboards, http://www.voodoolab.com/dingbat_landing.html (Last Updated Nov. 2019).

List of Patents or Applications Treated as Related, Jul. 2020.

* cited by examiner

PEDAL BOARD AND SYSTEM

CROSS REFERENCE TO RELATED APPLICATION(S)

This application is a non-provisional patent application claiming the benefit of the filing date of U.S. Provisional Patent Application Ser. No. 62/852,814, filed May 24, 2019, and titled "Pedal Board and System" which is hereby incorporated by reference.

BACKGROUND

The embodiments relate to the field of musical instrumentation and associated equipment. More specifically, the embodiments pertain to management of equipment associated with electric guitars as well as other electronic musical instruments as might be accompanied by foot-controlled and floor-located devices, such as special effect output devices.

A wide variety of pedal boards for use with electric guitars and such are known and available to musicians. Pedal boards are used to elevate, support and manage special effect and foot pedal devices and other equipment during operation of the instrument during performance. These pedal boards are, in general, structured for placement and positioning onto a planar floor surface and afford access for manual or podiatric operation by the musician. Many available pedal boards contain fenestrations or openings located on the upper panel surface of the board to place sound effect devices in an accessible location to the performer. Problems associated with many current pedal boards involve the arrangement, connections, control and management of the pedal devices, connectors and cords, and are prone to undesired disarray and unmanaged arrangement. Another problem associated with current pedal boards is the inability to readily view the equipment both above the pedal board and within it, which can in turn exacerbate the interference by and confusion of sorting out cords and connectors resident at the floor level during use, increasing the risk of misconnections. This is especially problematic when employing a large number of devices and equipment and attempting to coordinate and manage their usage in real time.

There exists a need in the field of music for instrumentation and equipment that facilitates instrument set up and arrangement, operation and performance of associated devices and equipment. There exists a further need for equipment which affords flexibility in positioning, management of connectable devices, and simultaneously provides ready access and visibility of equipment and their componentry.

SUMMARY

The embodiments provide a pedal board for use with electronic instrument output sound equipment comprising: a generally planar contiguous single-piece pedal board housing having a horizontal upper panel, opposing vertical front panel and vertical rear panel, and having an exterior surface and interior surface, and a pair of opposing first and second lateral ends, and a contiguous board edge running along the outer perimeter of the board housing in continuity with the panels. The upper panel comprises a plurality of fenestrations. A pair of opposing first and second vertical planar side trusses are positioned related to the pedal board, and positioned adjacent to the first and second lateral ends. Each of the first side truss and second side truss has a circumscribing perimeter, and opposing first and second planar exterior surfaces. The first planar side truss is attached to the first lateral end of the housing, and the second planar truss is attached to the second lateral end of the housing. In addition, each of the side trusses comprises a plurality of incrementally dimensioned portals therethrough.

A semi-rigid single-piece pedal device cover, also referred to herein as a riser, is provided for adaptive engagement with the pedal board housing upper panel through the fenestrations. The pedal device cover has a generally arcuate body comprising an upper portion contiguous with a pair of opposing first and second side portions, and an exterior surface and interior surface, and having open front end and open rear end. The pedal device cover further comprises a pair of opposing first and second flanges. The first flange extends outward from the bottom of the first side portion and the second flange extends outward from the bottom of the second side portion. Each of the first and second flanges comprises a mechanical coupling structure for cooperative removable engagement with the upper panel of the pedal device board housing. The pedal device cover is composed of a semi-rigid flexible material permitting tension-fit engagement of the mechanical coupling structure of the first and second flanges and fixation onto the upper board housing panel.

The pedal device board, as shown and described in the embodiments, can be constructed to have an upper panel which is inclined or tilted as formed by diverging and converging angles created by a front panel greater in height than a rear panel. The pedal device board can further comprise a floor plate attached to the bottom of the pedal board housing.

In another embodiment, the pedal board can further comprise one or more supplemental support trusses positioned within the panel board housing and between both of the side trusses. When employed, the supplemental support trusses can likewise comprise a plurality of incrementally dimensioned portals therethrough as that of the side trusses. In one embodiment, both side truss portals and support truss portals can incrementally increase in size from the rear edge toward the front edge of the truss in coordination with a corresponding upper panel incline angle.

The embodiments further provide a pedal board system comprising the pedal board in combination with an illumination display device that can cooperatively utilize the pedal device board material for visual effect. Preferably, the material used for at least the pedal board housing is composed of a transparent or semi-transparent thermoformable plastic material.

The embodiments provide a number of benefits and advantages. By virtue of its construction and materials, the pedal board of the embodiments offers the following: an ability to employ lightweight material construction; cost-effective and simple construction, assembly and manufacture; easily and rapidly customization options for arrangement and preferences, such as placement and adjustment of input and output connections; control and management of cords and wires associated with equipment; a board and cover assembly that simultaneously provides easy physical and visible access of pedal devices while protecting the pedal devices (controls, wiring, knobs, and the like) from unintentional physical operation, accidental disconnection of cords and wires from the pedal device, and undesired migration of the pedal devices on the pedal board. When constructed using transparent, semi-transparent materials, the embodiments permit viewing of interior of pedal board and devices and equipment placed within. When used in combination with an illumination display system, the embodiments offer a variety of display illumination possibilities and design, such as brand names, logos, and the like. These and additional advantages will become apparent from the following description.

BRIEF DESCRIPTION OF THE DRAWINGS

The invention is further illustrated by the following figures containing numeric and symbolic references which remain consistent throughout. None of the illustrated embodiments in the figures are intended to be construed as further limiting.

DETAILED DESCRIPTION OF THE INVENTION

As used herein, the terms "pedal" and "pedal device" are generally used to describe the associated sound effect devices and equipment for use in conjunction with the pedal board and system of the invention. Nevertheless, the terms are intended to encompass any sound effect device comprising controls and adjustment structures for their operation, including a foot-operated button switch, and which may or may not contain a hinged pedal structure operable by the user's foot. For instance, sound effect devices can contain exclusively manually operable knobs and controls, or alternatively, include both hand-operated manual controls in combination with a podiatric adjustment structure such as push button or vertically-adjustable conventional foot pedal. The term, as well as the term "equipment" discussed in the same context, are meant to generally refer to connectable devices which are typically positioned at floor level in use in proximity to, and accessible to, the user (i.e., musician), including but not limited to, tuners, delays, reverbs, modulators, compressors, overdrives, equalizers, and the like.

The terms "front" and "rear" when used to describe locations of structural features of the pedal board of the invention are used in reference to the panel board device as placed in relation to the user such that the "front" is oriented away from the user toward an audience, for example, and the "rear" is oriented in closer proximity to, and most accessible to, the user. Similarly, when sides of the embodiments are referred to with the terms "left" and "right," the terms are used from the perspective of viewing the device facing forward toward the front from rear—from which the terms are used from such point of reference.

The terms "vertical" and "horizontal" when used to describe the features of the pedal board are meant to refer to directional orientations relative to a floor or horizontal planar surface upon which the pedal board can be placed. As used herein, the terms "inner," "outer," "interior," "exterior," "inward" and "outward," and inflections thereof, when used to described components of the invention are used relative to the exterior and interior areas of the board panel structure in an assembled state.

The phrase "generally planar" is used to refer to an overall configuration wherein the length and width dimensions are substantially greater than the depth of thickness dimension. When used to refer to specific components of the embodiments, the term "planar" is intended to encompass such a configuration and having some degree of variation of the planar dimensions within the confines of an overall plane structure and which permits insubstantial deviations in panel thickness and surface levels (e.g., curvature) provided the functionality of the planar component is not substantially or adversely effected.

Figure 1:
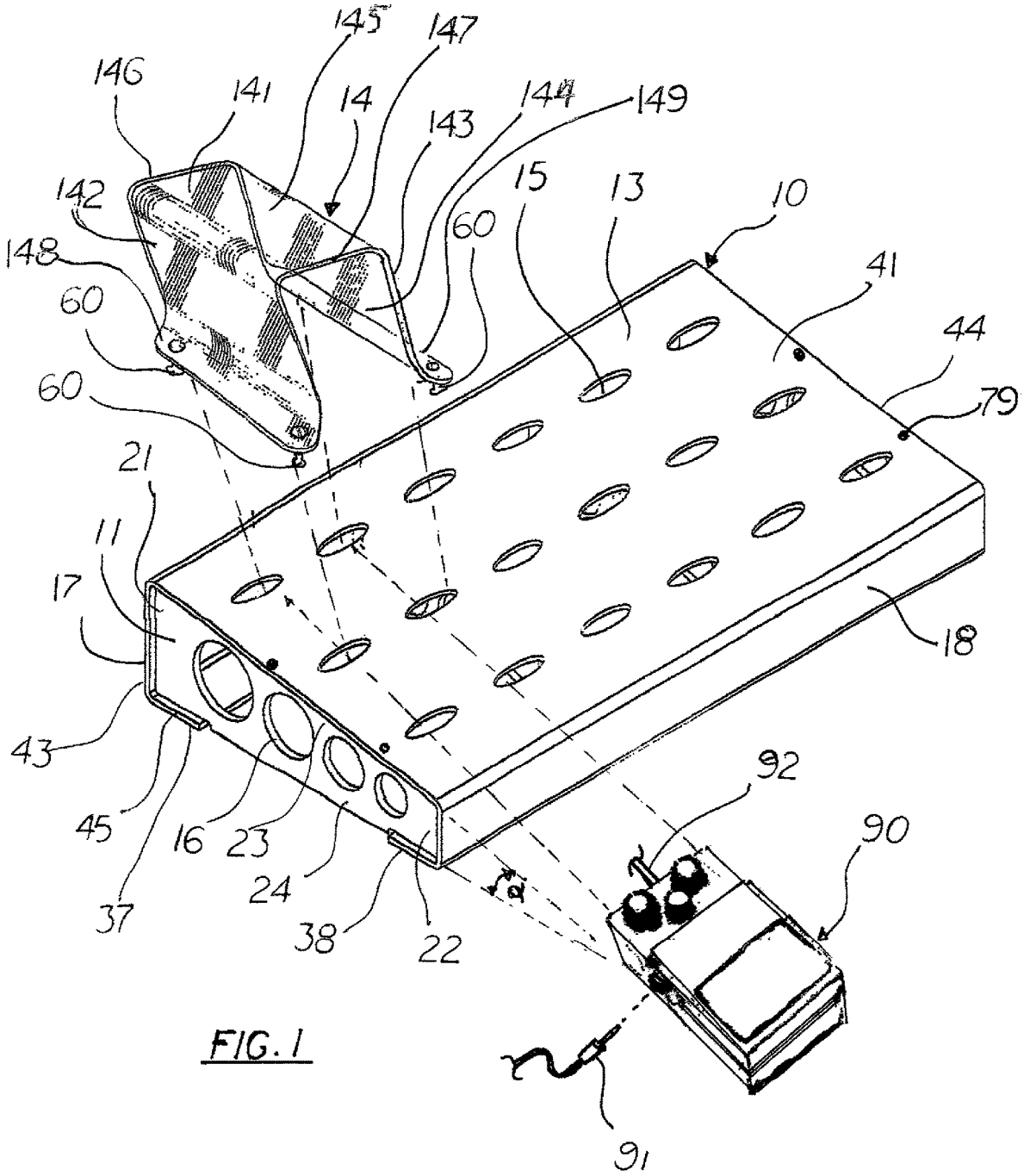
FIG. 1 is a partially disassembled schematic view of the pedal board and a pedal device showing the pedal cover detached and placement of a pedal device on the board, according to one embodiment.
Figure 6:
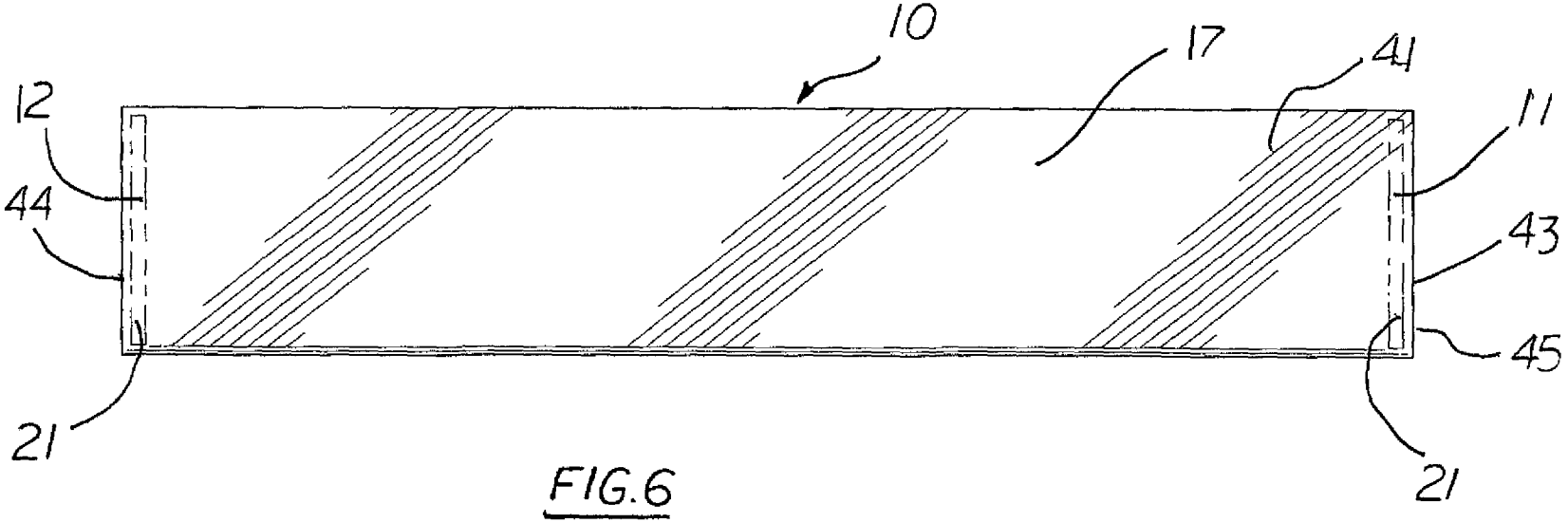
FIG. 6 is a front side view of the panel board according to one embodiment.
Figure 7:
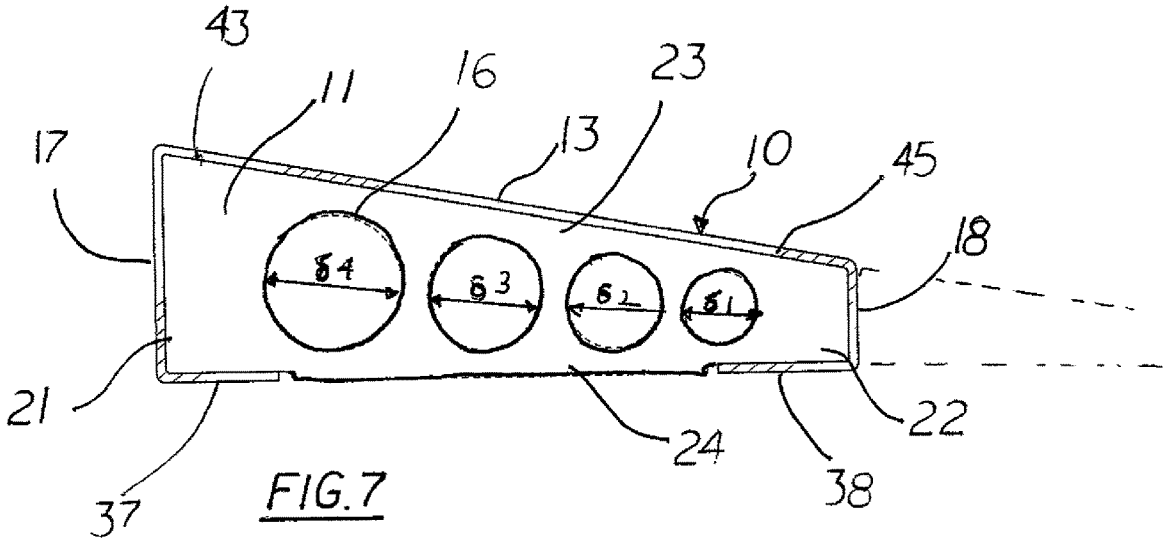
FIG. 7 is a left side view of the pedal board housing with a phantomized view of a side truss according to one embodiment.
Figure 8:
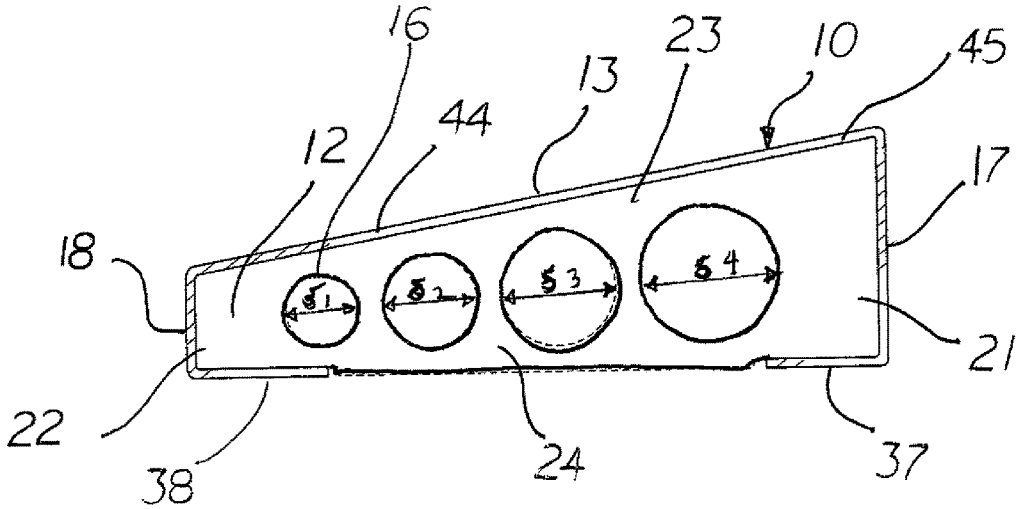
FIG. 8 is a right side view of the pedal board housing with a phantomized view of a side truss on the opposing housing lateral end to that depicted in FIG. 7 according to one embodiment.

Referring to FIG. 1, the pedal board and system of the invention generally comprises a pedal board housing (10) having an upper panel (13), front panel (17) (see FIG. 6) and rear panel (18), and a pair of opposing side trusses (11) and (12) (see FIGS. 7 and 8) supporting a fenestrated upper panel (13) of the board housing (10). The embodiments can further comprise a pedal device cover (14) that cooperatively engages the upper panel of the board housing through the fenestration(s) (15). The first and second side trusses, (11) and (12), respectively, can comprise portals (16) passing through the side trusses (11) and (12). Together, the upper panel fenestrations (15) and truss portals (16) afford a wide variety of options for positioning one or more pedal devices (90) and their associated connectors and cords (shown in FIG. 1 as a separated pedal device output connector (91) and power cord (92)). For example, in one embodiment, the pedal device (90) may be positioned within the device cover (14), or on a top surface of the device cover (14). Similarly, in one embodiment, two pedal devices (90) may be positioned relative to the device cover (14), including a first pedal device (90) positioned within the device cover (14) and a second pedal device (90) positioned on the top surface of the device cover (14). The pedal board and system are constructed for use with electrically connected output sound effect equipment (see FIGS. 20 and 21, for instance) associated with electrical instruments, such as electric guitars (not shown).

Pedal Board Housing

Figure 4:
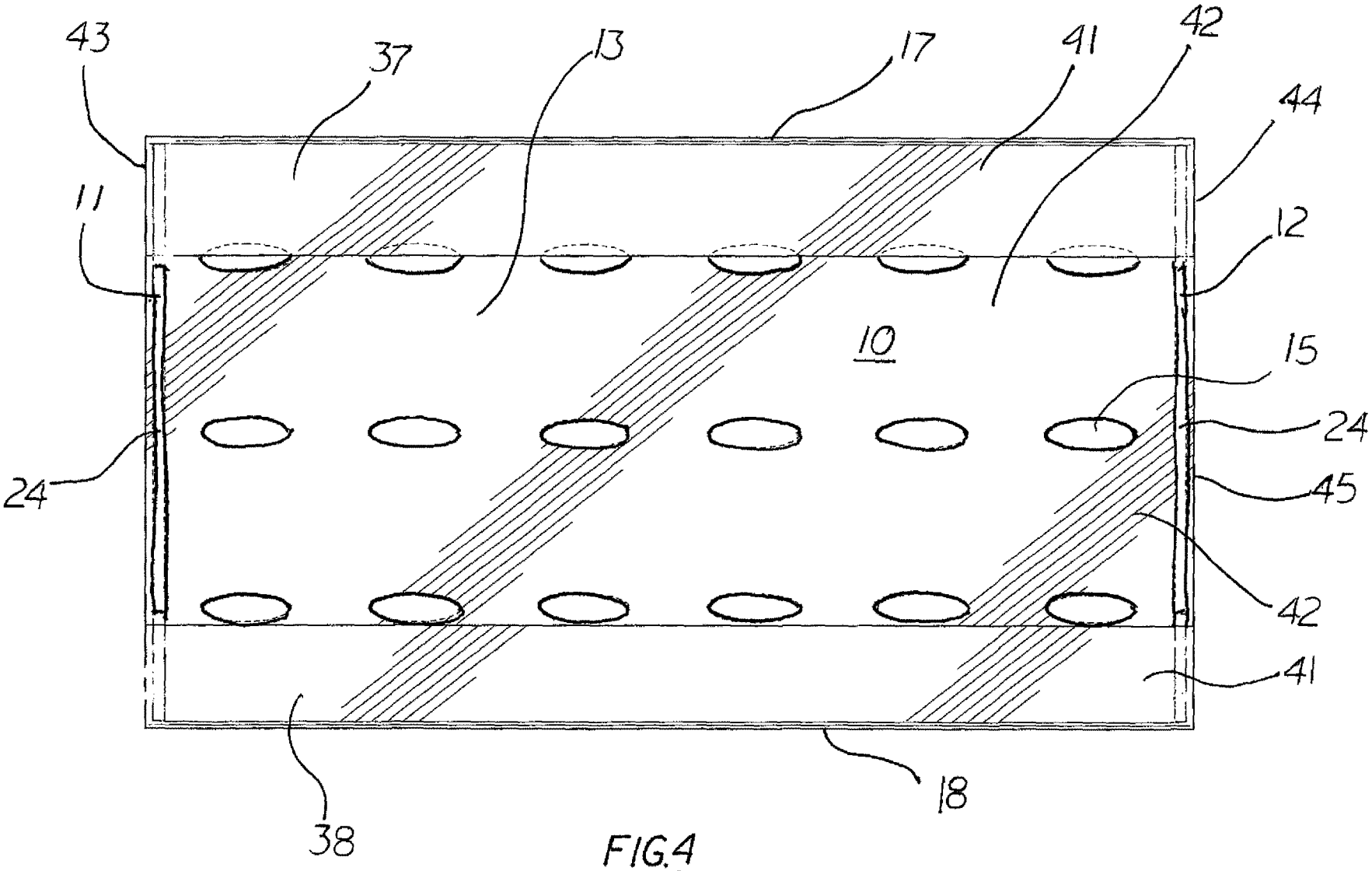
FIG. 4 is a transparent bottom view of the interior surface of the pedal board, fenestrations and side trusses according to one embodiment.

The pedal board of the embodiments comprises a pedal board housing (10) formed from an upper panel (13), front panel (17) and rear panel (18) creating a containment having a hollow interior compartment. The pedal board housing (13) can be constructed as a generally planar contiguous single-piece board housing, e.g. monocoque, (as shown) having a horizontal upper panel (13), opposing vertical front panel (17) and vertical rear panel (18), and having an exterior surface (41) and interior surface (42) (see FIG. 4), and a pair of opposing first and second lateral ends (43) and (44), respectively, and a contiguous board edge (45) running along the outer perimeter of the board housing in continuity with the panels. The upper panel (13) can comprise a plurality of fenestrations (15). The front panel (17) can comprise an inward extension at its bottom portion to form a contiguous front panel base (37), and the rear panel (18) can comprise an inward extension at its bottom portion to form a rear panel base (38).

The overall dimensions and configuration of the pedal board housing (10), i.e., the length, width, depth, can vary according to its anticipated use and the intended equipment and devices with which it is to be used. For instance, the pedal device board of the embodiments can be sized to accommodate six pedal devices to be resident on the upper panel for example, or alternatively, dimensioned so as to accommodate two to eight pedal devices, or more, each with an associated pedal device cover (14) placed over the pedal devices (90). As shown in the figures, the pedal board housing (10) has an overall three-dimensional hollow rectangular box configuration having an interior compartment. In another embodiment, the pedal board housing can comprise a square upper panel configuration forming an overall three-dimensional hollow cuboid box configuration, for instance, provided the functionality of the pedal board housing and pedal box are not substantially affected. Regardless of the overall configuration, the pedal board of the embodiments should arrange and align the pedal devices used in a manner to be easily accessible for operation by the user's feet.

Figure 5:
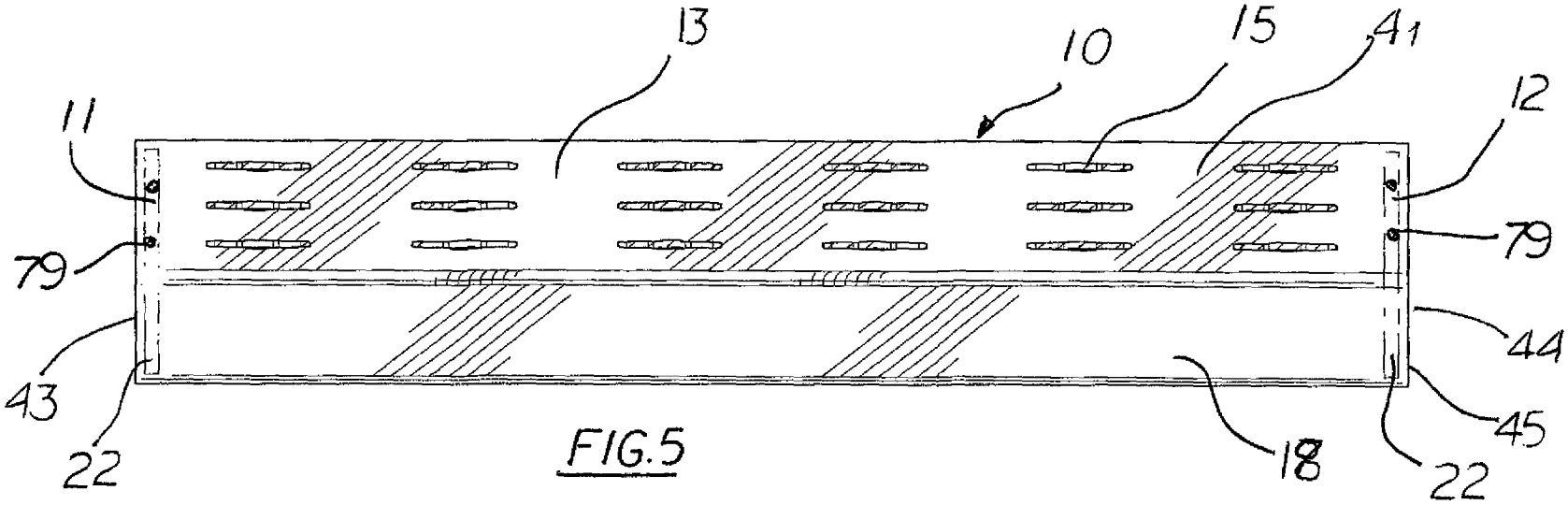
FIG. 5 is a rear side view of the panel board according to one embodiment.
Figure 11:
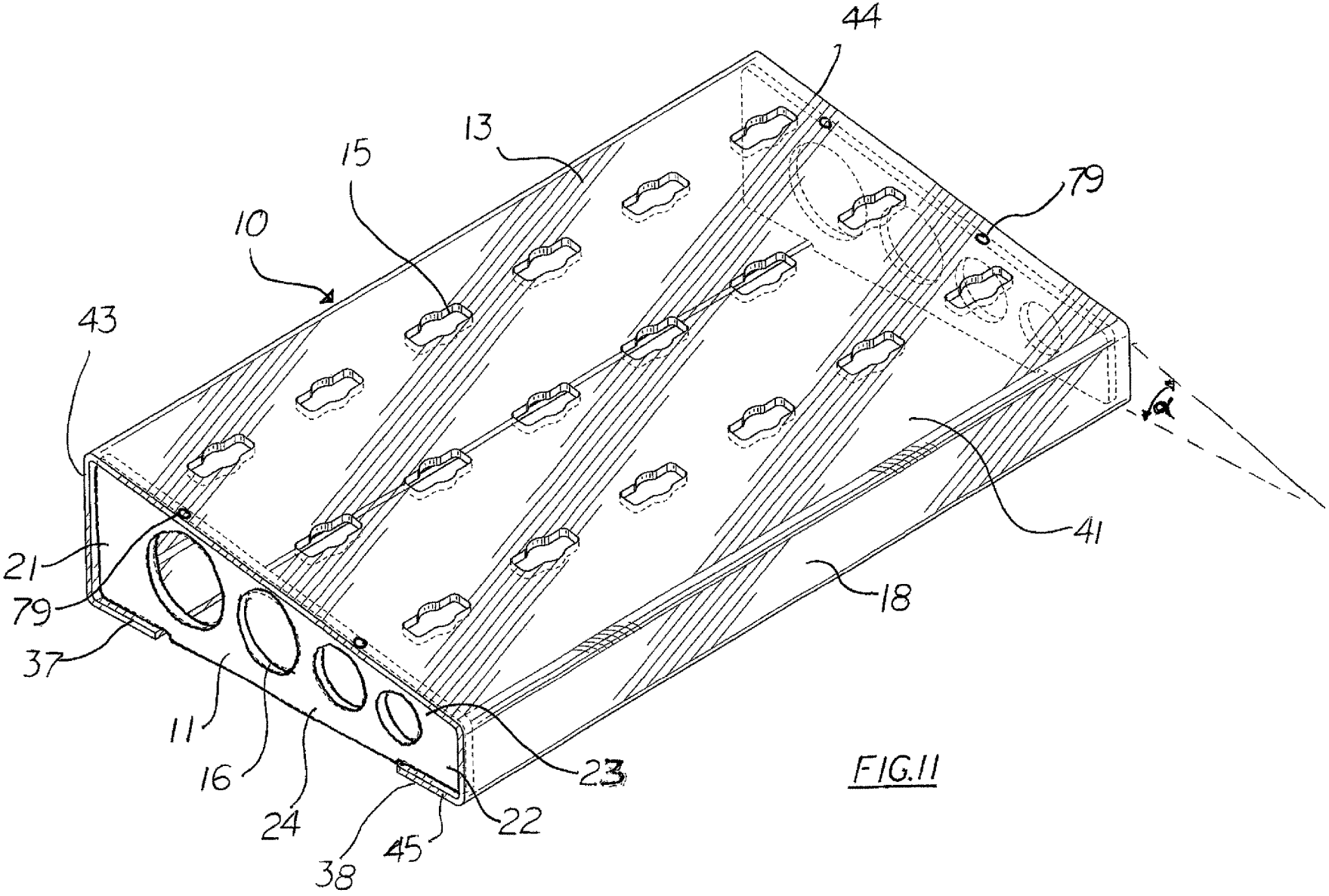
FIG. 11 is a partially transparent angled top view of the pedal board housing having an alternative fenestration configuration according to one embodiment.
Figure 12:
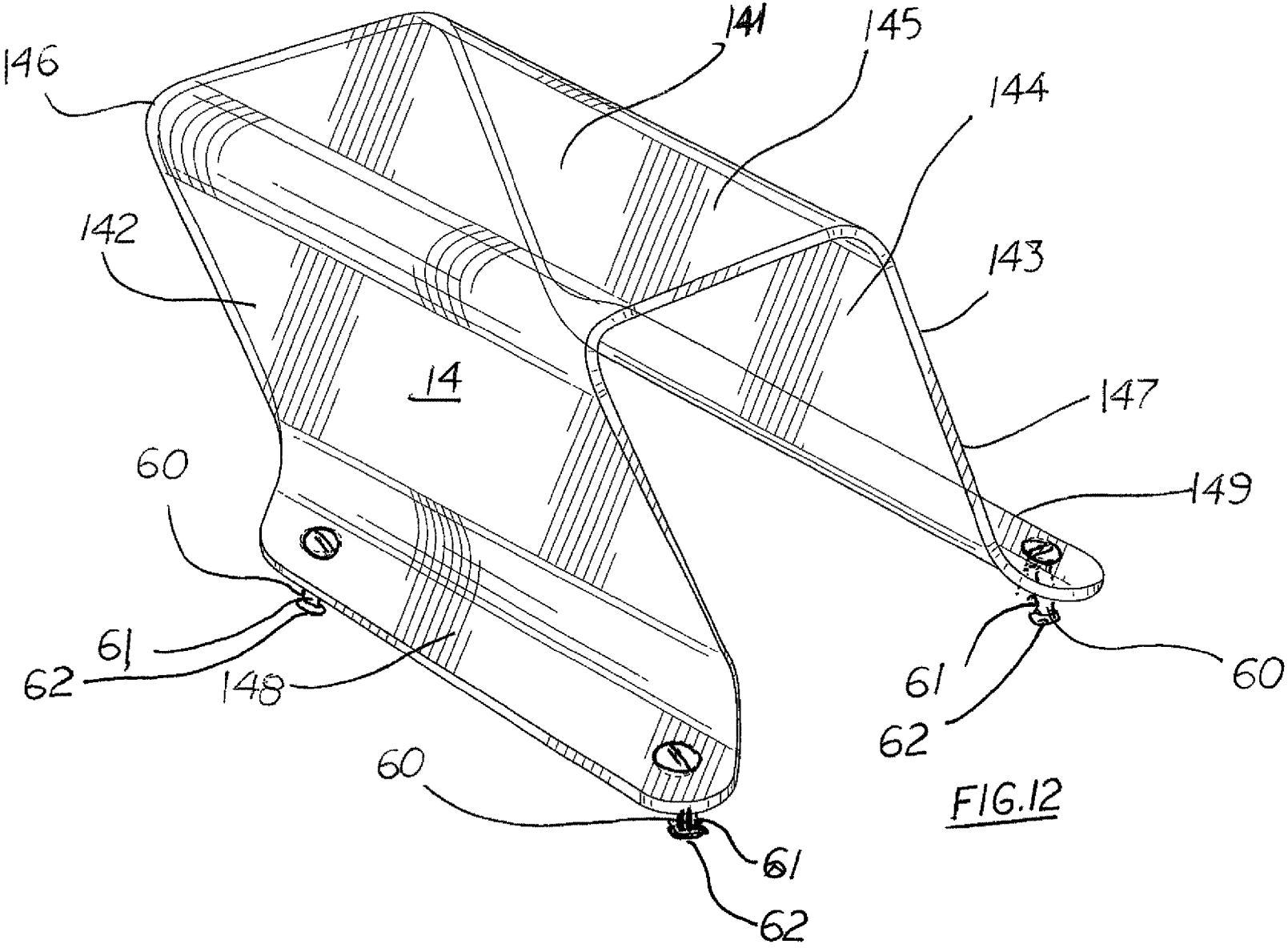
FIG. 12 is a transparent angled top view of the pedal device cover with flush flange configuration according to one embodiment.
Figure 13:
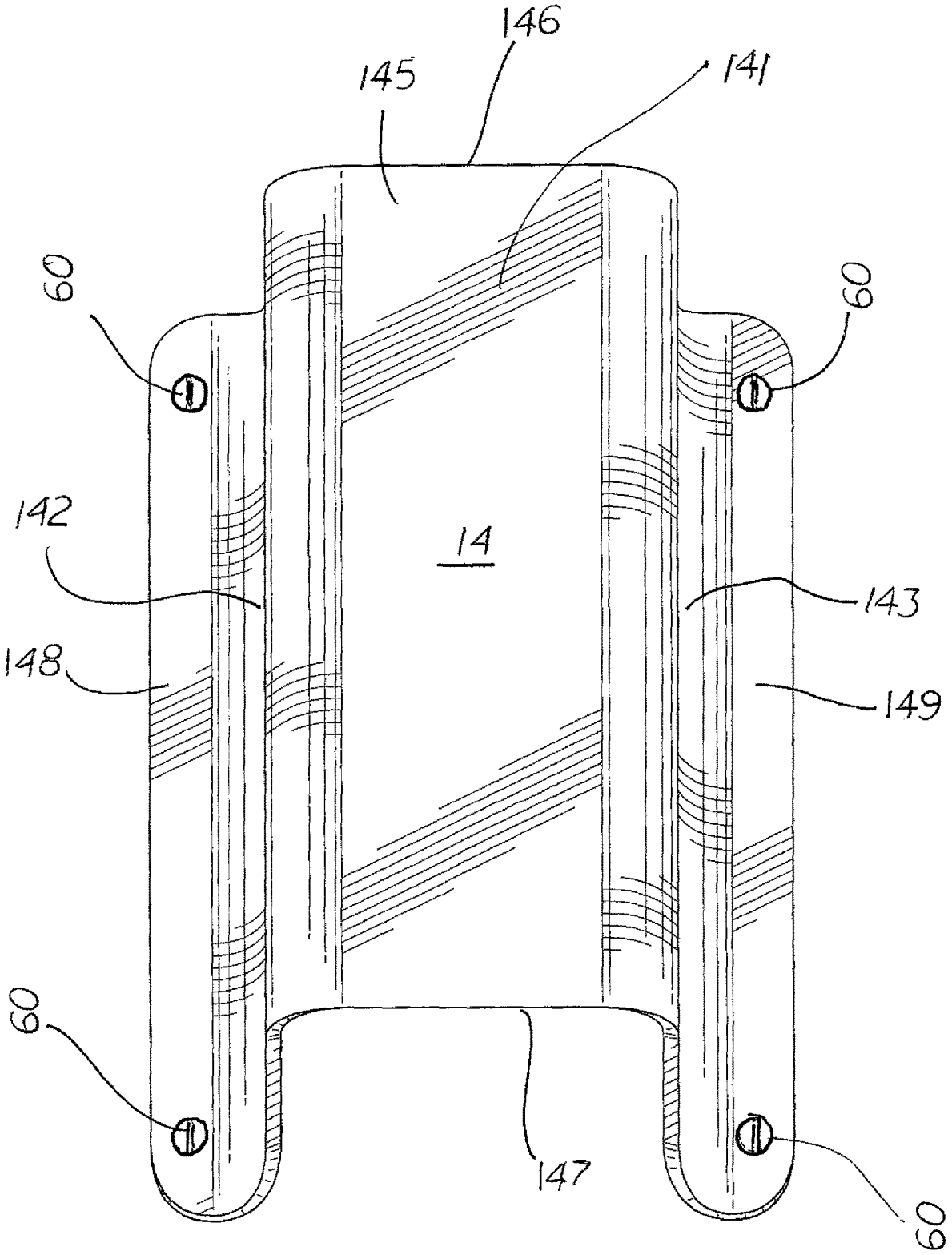
FIG. 13 is a transparent top view of the pedal device cover with flush flange configuration according to one embodiment.
Figure 14:
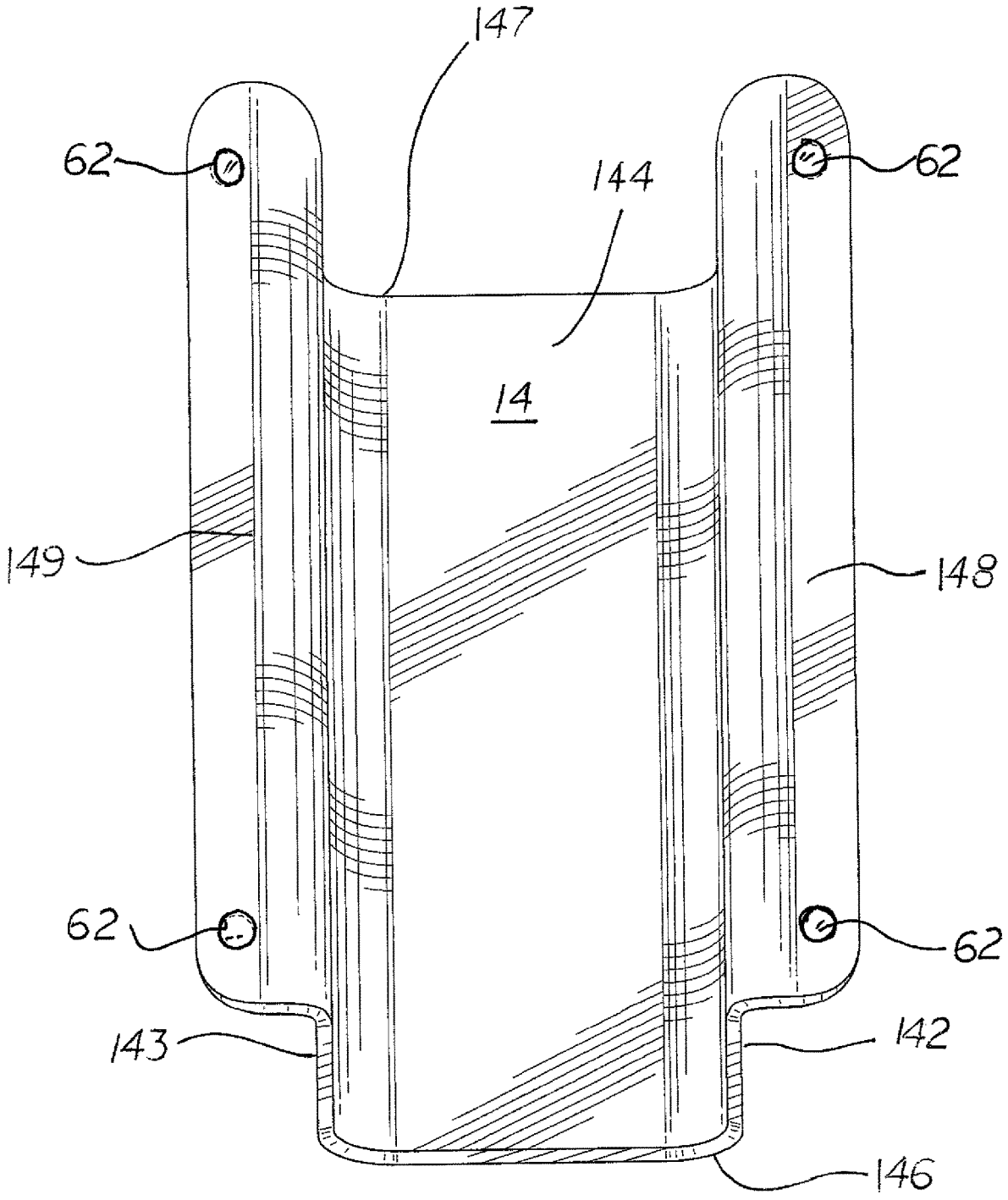
FIG. 14 is a transparent bottom view of the pedal device cover with flush flange configuration according to one embodiment.
Figure 15:
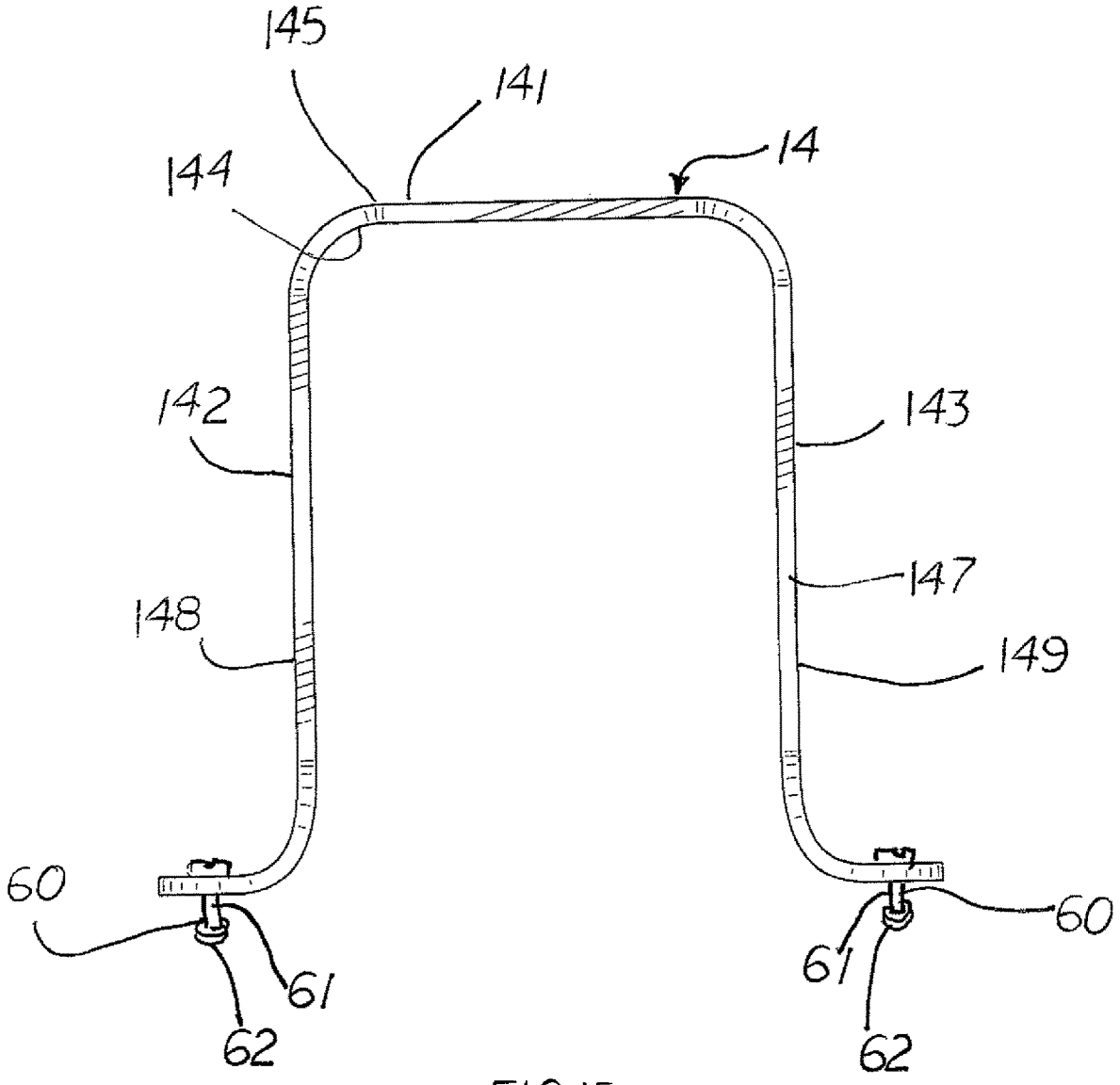
FIG. 15 is a rear end view of the pedal device cover with flush flange configuration according to one embodiment.
Figure 16:
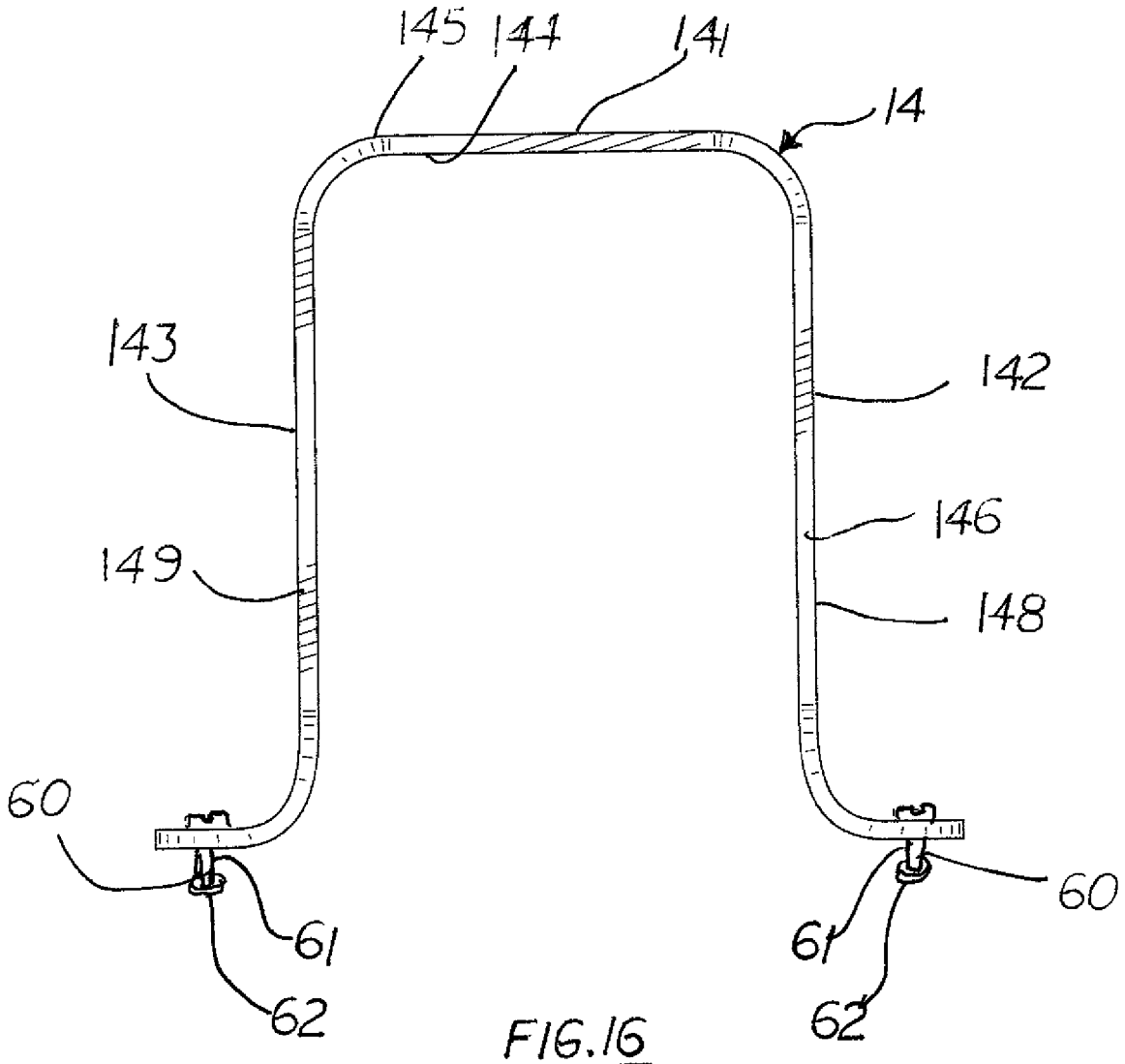
FIG. 16 is a front end view of the pedal device cover of the opposing end to that shown in FIG. 15 according to one embodiment.
Figure 17:
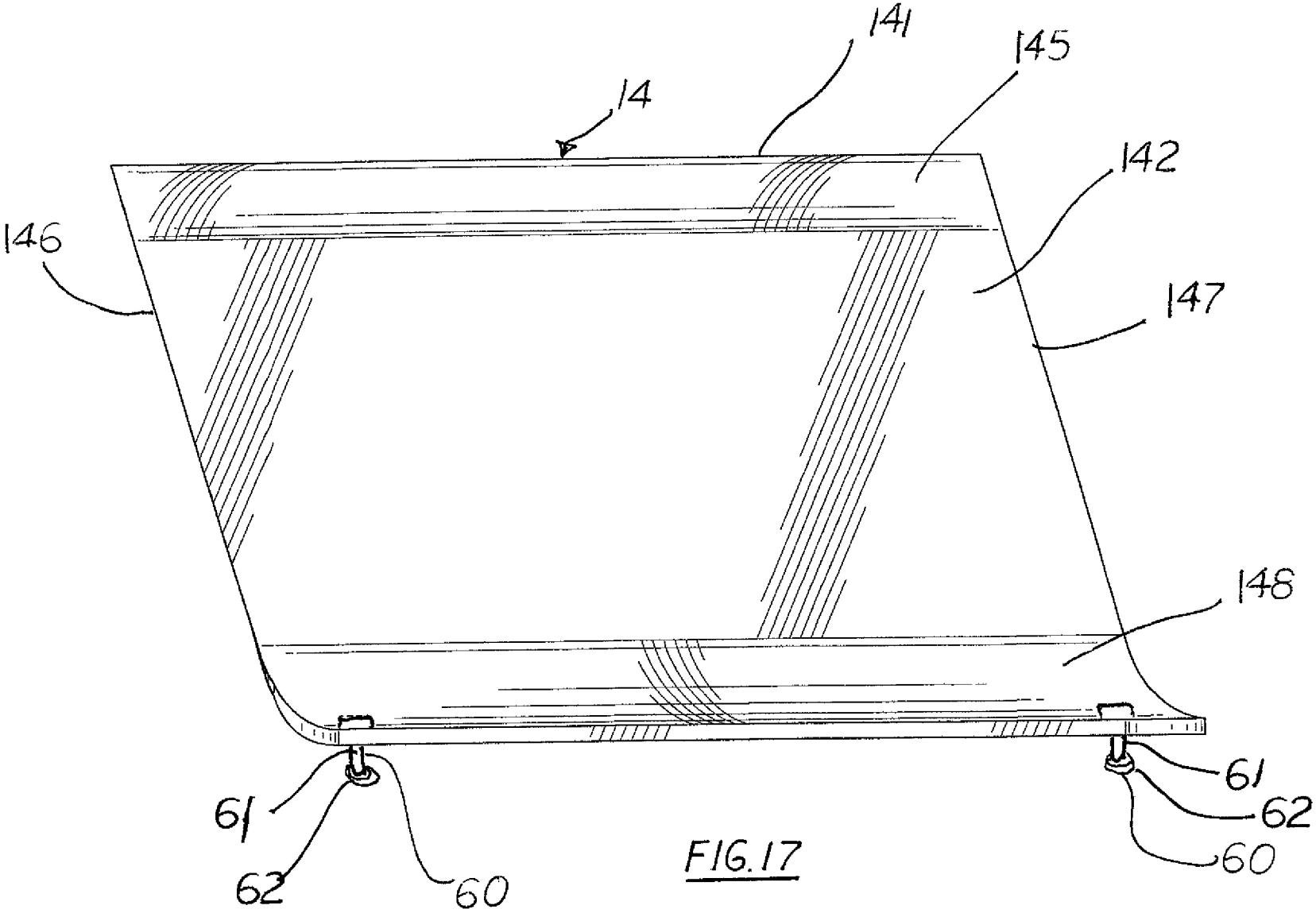
FIG. 17 is a side view of the pedal device cover having a flush flange according to one embodiment.

The configuration, dimensions, location and number of the fenestrations (15) can vary, provided they can cooperatively engage with the pedal device cover (14) to secure the cover (14) onto the upper panel (13) of the board. Although depicted in the figures as having ovoid shape (see FIG. 2, for example) or, alternatively, a keyhole shape (as shown in FIGS. 5 and 11), the configuration of the fenestrations (15) can be any shape that permits reception and insertion of the mechanical coupling structure (60) of the pedal device cover (14) therewith. Since an important aspect of the embodiments is the customizability and ability to quickly re-arrange the pedal devices (90) and their associated covers (14), it is preferable that the fenestrations (15) be structured such that the width (i.e., laterally oriented shape) is greater than the front-to-rear oriented length. This is so the preferred outward tension fit in the lateral direction of the pedal device cover (14) and its mechanical coupling structure (60) (see FIG. 26) can successfully reside within the fenestration(s) (15) of the upper panel (13) with reduced likelihood of undesired lateral and vertical migration of the cover (14) during usage.

Figure 20:
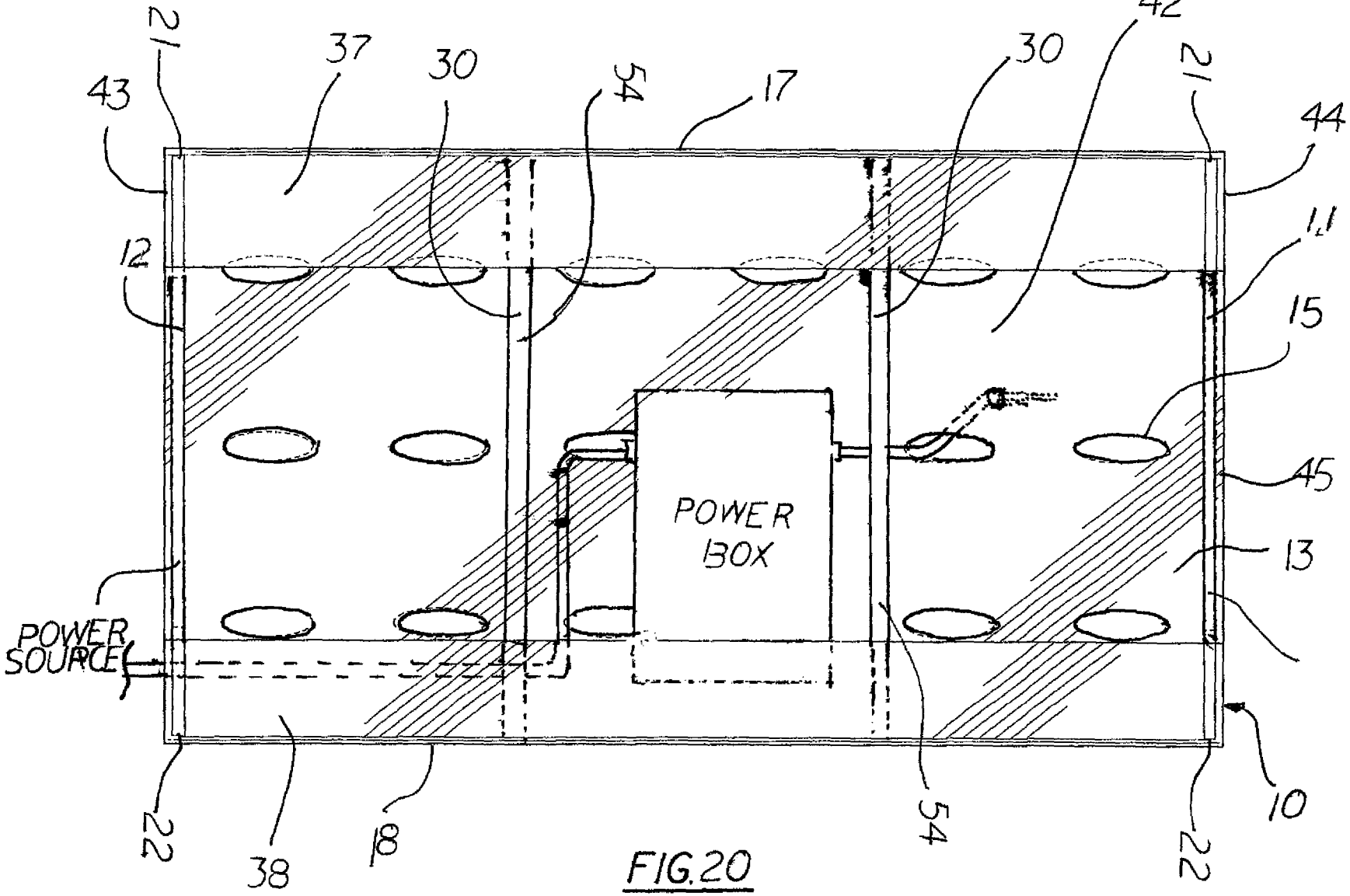
FIG. 20 is a bottom schematic view of the pedal board showing an arrangement of interior located equipment according to one embodiment.
Figure 21:
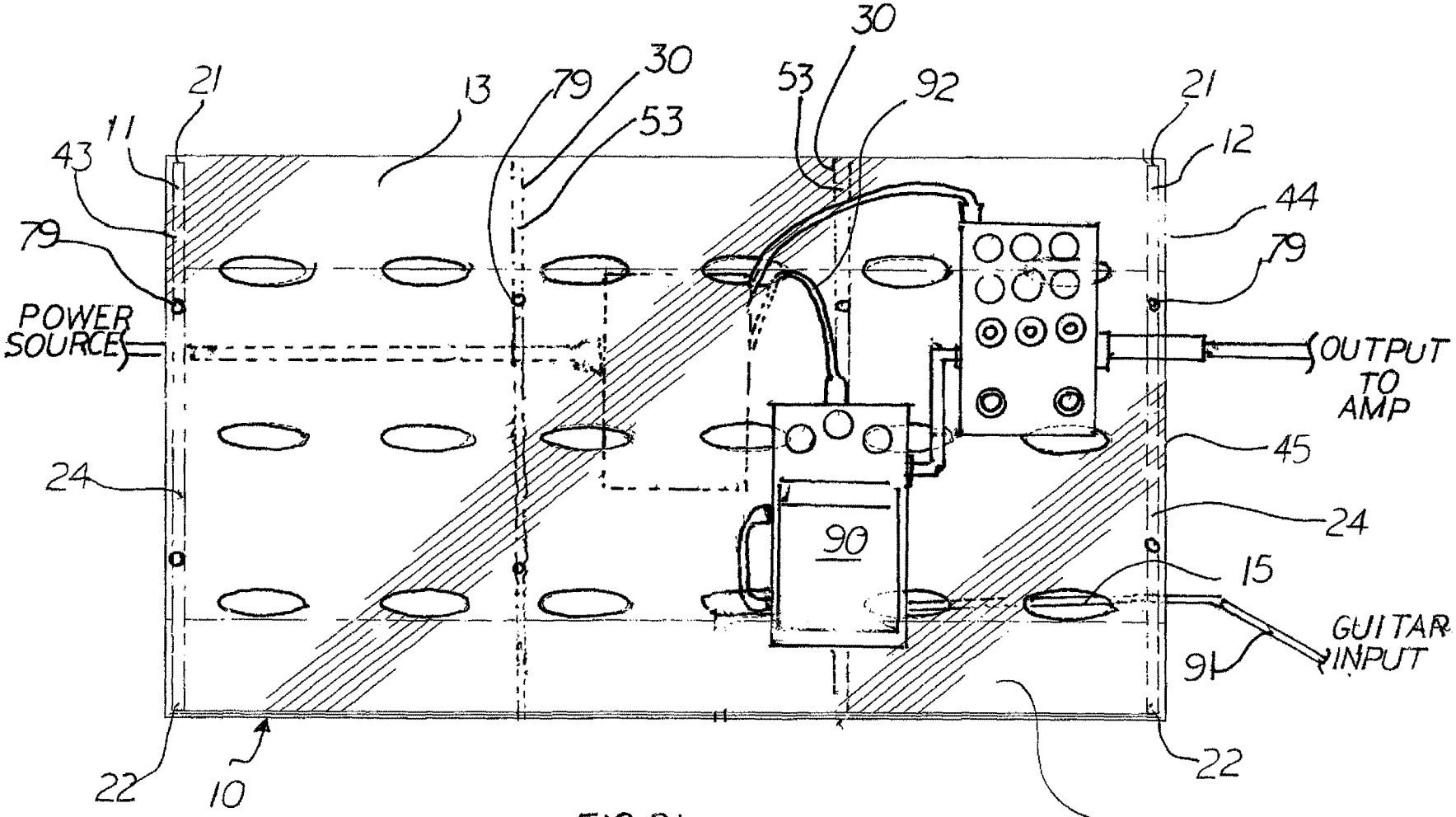
FIG. 21 is a transparent top schematic view of the pedal board showing an arrangement of a pedal device and equipment on the exterior upper panel surface of pedal board housing according to one embodiment.

As shown in FIG. 20 and FIG. 21, in addition to functioning to engage and secure a pedal device cover (14), the fenestrations (15) serve the additional and simultaneous function of management and control of connectors, cords and wires used with the pedal devices (90) and other equipment. In use, the cords and wires running from the devices located on the exterior surface (41) of the upper panel (13) can be inserted through the fenestrations (15) and into the interior compartment of the pedal board housing (10)—using fenestrations (15) either inside and within the secured pedal device cover (14) or outside the same, so that the cords or wires run into the internal compartment of the pedal board. This advantage of the embodiments reduces the likelihood of mechanical interference of the cords and wires with surface equipment, and inhibits disarray of connectors, cords and wires.

Floor Plate

Figure 10:
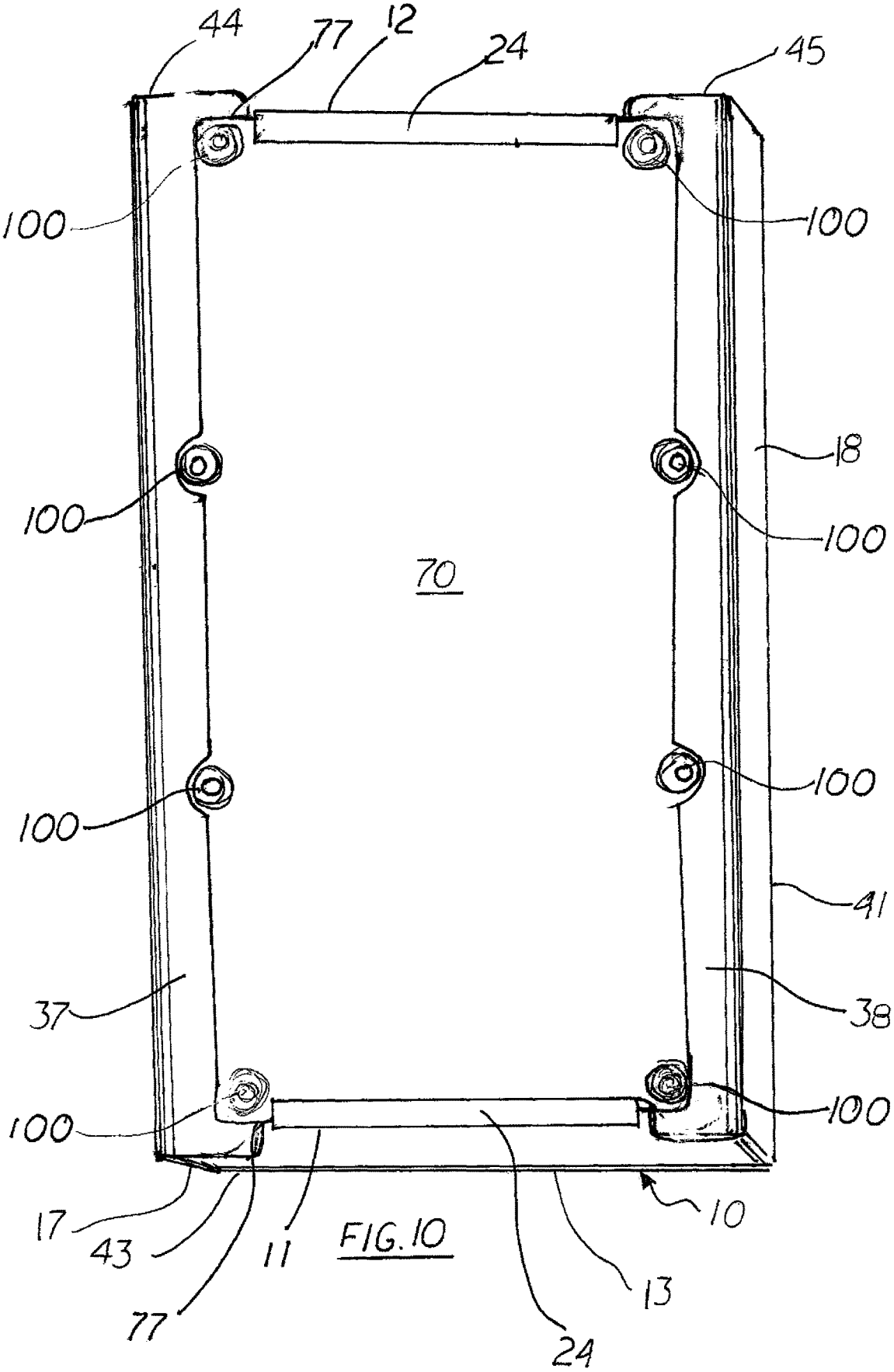
FIG. 10 is a bottom view of the pedal board showing a floor plate attached to the pedal board housing, according to one embodiment.
Figure 27:
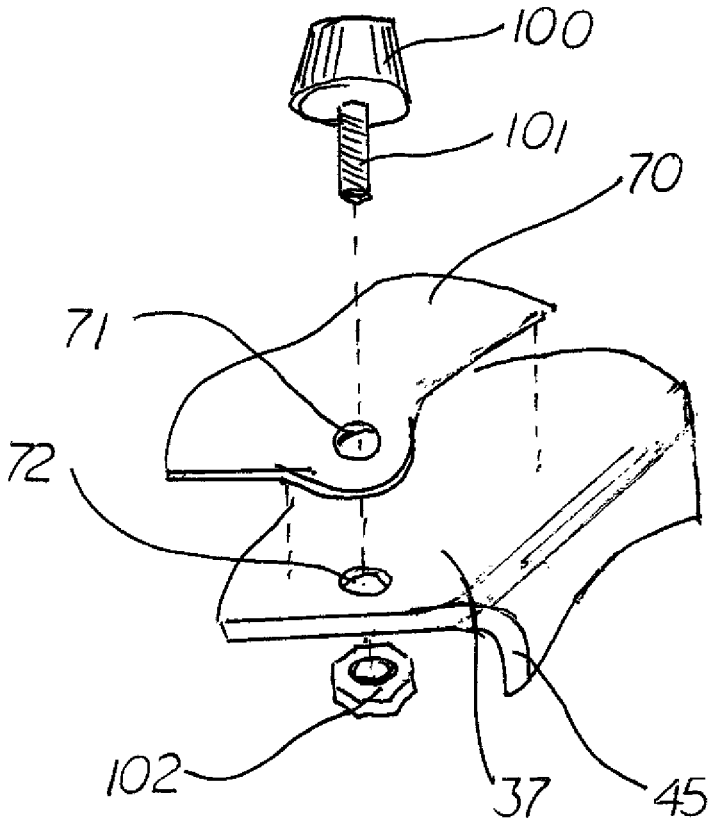
FIG. 27 is an angled separated view of a corner portion of a floor plate and board housing with disassembled footed fastening structure according to one embodiment.

Referring now to FIG. 10, in one embodiment, the pedal board housing (10) can further comprise an attachable floor plate (70) having dimensions (i.e., length and width) substantially co-extensive with that of the underside of the pedal board housing (10). Floor plate (70) can vary in thickness. The floor plate (70) can be attached to the front panel base (37) and rear panel base (38) of each of the front panel (17) and rear panel (18) of the board housing (10) by a variety of means. Given the desirable customizable attributes of the pedal board of the invention, the floor plate (70) can be removably attached to the base of the housing to facilitate access and arrangement of devices, equipment connectors, cords and wires. The floor plate (70) is depicted as a planar sheet of rigid material secured onto the underside of the housing (10) through inward extending base portions (37)

and (38) of the front panel (17) and rear panel (18) respectively (see FIG. 10), and can be secured into position using attachable feet (100) having a threaded post (101) passing through in alignment with and through floor plate holes (71) and housing base hole (72) of the housing (10), wherein the threaded post (101) is coupled to a receiving threaded nut (102) (as shown in FIG. 27, for example).

A variety of attachable feet structures (100) which simultaneously function to secure the floor plate (70) onto the housing (10) and inhibit or mitigate slippage of the pedal board on a floor surface are possible, including but not limited to, knurled knobs, elastomeric pegs, and the like that can be inserted through coordinated openings (71) and (72) of the floor plate (70) and front panel base (37) and rear panel base (38) inward extensions. Additional embodiments for attachment of the floor plate (70) to the underside of the pedal board housing (10) are also possible. For example, suitable attachment structures can include snap-fit tabs, for example. Referring to FIG. 10, in addition to attachable feet (100), the bottom portion (24) of first and second side trusses (11) and (12), can comprise longitudinal sliding rails (not shown) which movably accommodate opposing edges (77) of the floor plate (70). Thus, the side trusses (11) and (12) additionally can function to secure a floor plate (70) to the pedal board.

As shown through the figures, the pedal device board and its housing (10) can be structured to have an upper panel (13) which provides an inclined or tilted plane relative to a horizontal floor surface upon which the pedal board is placed. Referring to FIG. 1 and FIG. 11, the inclined embodiment can be formed by diverging and vertical height and thus forming a pedal board configuration with a trapezoidal side profile as shown in the figures. The degree and extent of incline can vary according to preference. Generally, some degree of incline is desired to the user can more easily operate the pedal devices using the foot with greater comfort. The incline angle (represented as Greek symbol alpha $\alpha$) as measured using the rear to front planar orientation of the upper panel (13) of the pedal device board housing (10) relative to the planar surface of a floor upon which the pedal board rests, can vary ranging from about 0 degrees to about 30 degrees, and preferably about 10 degrees. The degree of angle $\alpha$ of the upper panel should not be so great as to encourage unintended migration and slippage of the pedal device(s) (90) on the upper panel (13) of the pedal board.

Figure 22:
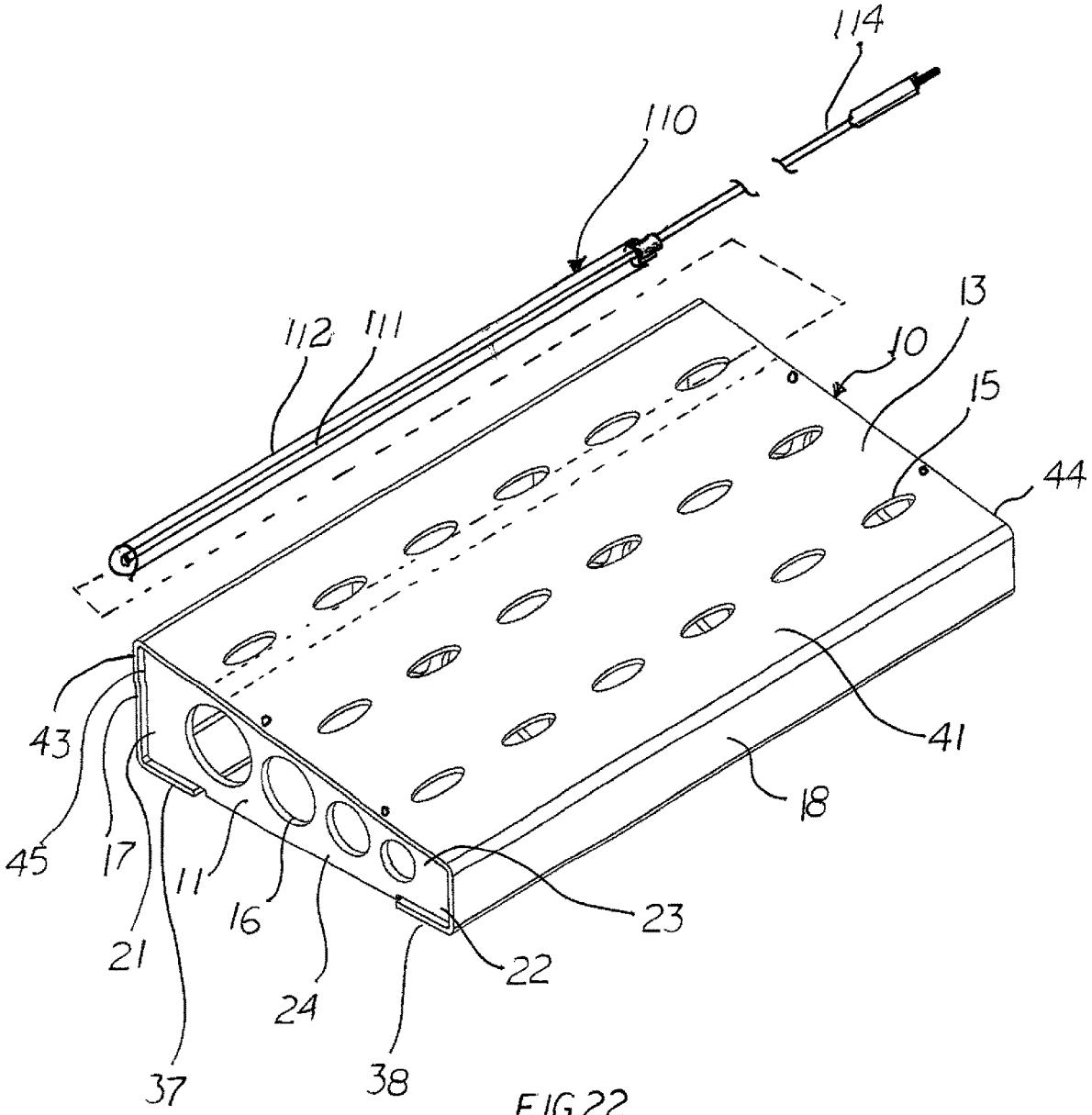
FIG. 22 is a transparent partially disassembled angled top view of a pedal board system showing an illumination display device for placement adjacent the interior surface of the front panel of the board housing, according to one embodiment.
Figure 23:
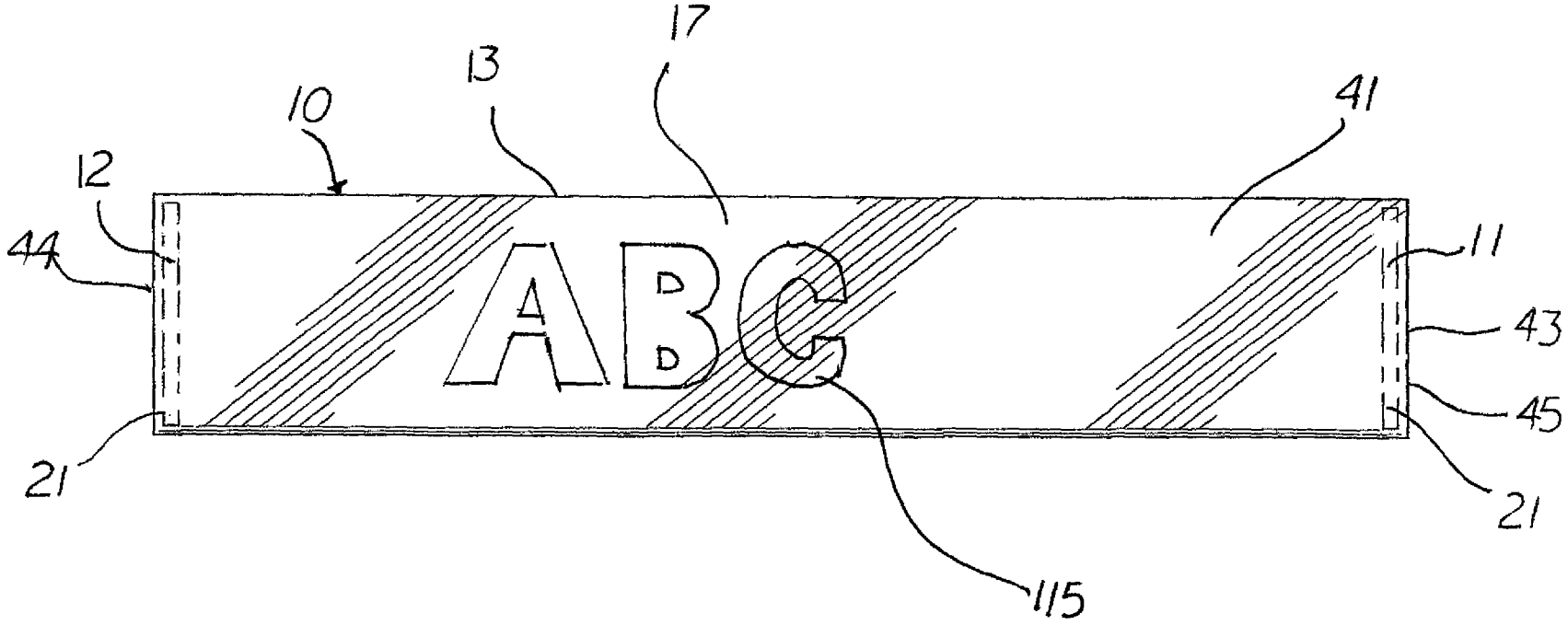
FIG. 23 is a front view of the front panel of the board housing with illumination display device and illustrated displayed image, according to one embodiment.
Figure 25:
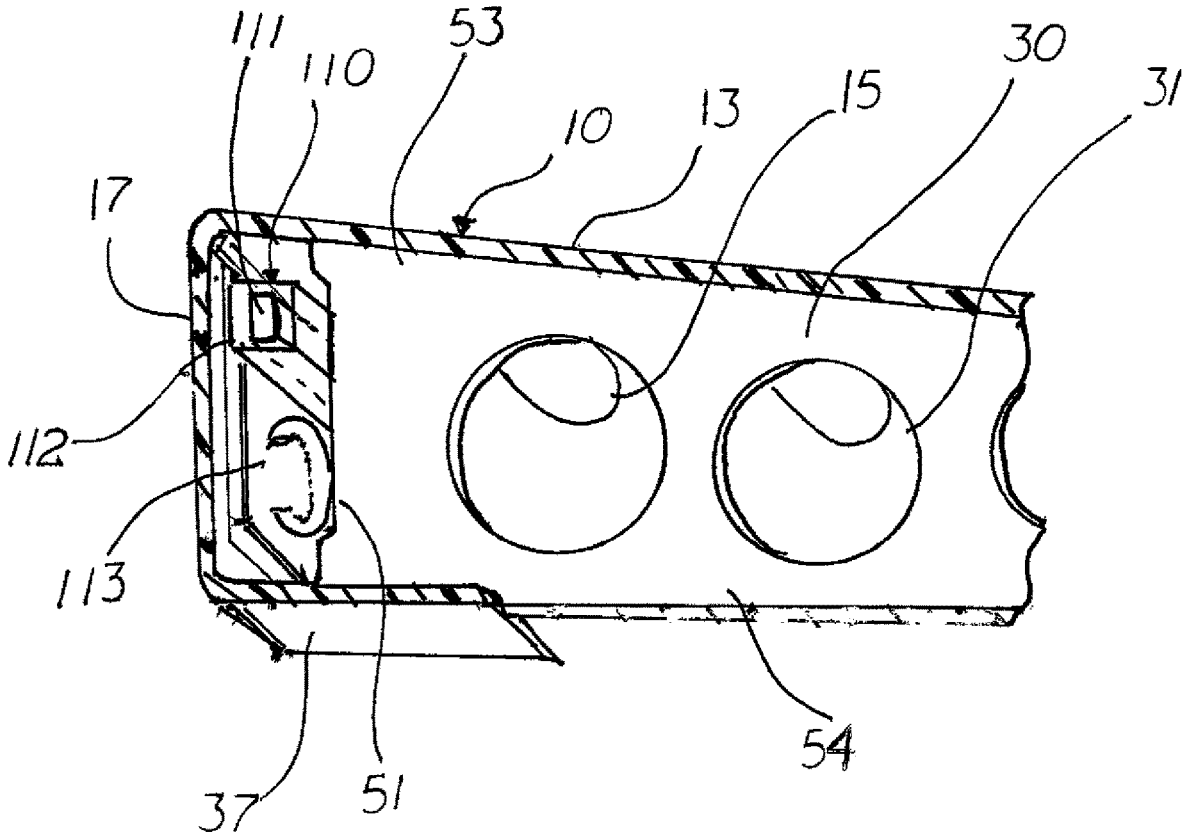
FIG. 25 is an angled cutaway side view of a medial portion of a pedal board showing a portion of a light source between a front panel and support truss according to one embodiment.

In addition to the pedal board supporting pedal devices (90) and other equipment on the exterior surface (41) of the upper panel (13) of the pedal board housing (10), the pedal board housing (10) can also be structured and dimensioned to accommodate equipment and devices within its interior compartment—namely by virtue of the height dimensions of the housing (10) at the front panel (17) and rear panel (18), overall width of the housing (10) and pedal board, and the dimensions of the corresponding side trusses (11) and (12) and support truss(es) (30), if present. Examples of additional equipment and devices that can be internally positioned within the pedal board include, but are not limited to, power boxes, junction boxes, connectors and cords associated with the musical instrument(s) and sound effect and pedal devices (90), illumination display devices (110), and the like as shown in FIGS. 20, 21 and 22. In one embodiment, the pedal board is dimensioned and structured to accommodate an illuminated display device (110) positioned within the housing (10), as shown in FIGS. 22 and 25.

The embodiments afford the benefits associated with single piece construction, e.g. monocoque, of the pedal board housing (10) using a single formable material. Nevertheless, it is possible to construct the pedal board using an upper panel, front panel and rear panel attached together during manufacture or at time of assembly by the user. The advantages and benefits of the embodiments are, however, best realized with contiguous construction as a single piece structure formed with bends to form elongated edges coextensive with the width of the pedal board along the juncture of the upper panel (13) with the front panel (17) and rear panel (18), and again at the juncture of the front panel (17) and front panel base (37) and rear panel base (38). The angle of the bends of the housing relative to the interior surface of the housing can vary according to design preference and can cooperate with the incline or tilt of the pedal board housing (10), and accordingly the interior angles of the same can range from between about 80 degrees to about 110 degrees, or 90 degrees at specific juncture locations, for instance.

Trusses

The pedal board of the embodiments can comprise a pair of opposing first and second vertical planar side trusses (11) and (12). Each of the first side truss (11) and second side truss (12) can have a circumscribing perimeter having a front portion (21), rear portion (22), upper portion (23) and base portion (24), and opposing first and second planar surfaces. When assembled, the first planar side truss (11) is attached to the first lateral end (43) of the housing (10), and the second planar side truss (12) is attached to the second lateral end (44) of the housing (10). Preferably, the perimeter of the side trusses (11) and (12) conformably reside mechanically adjacent to, and in structural support of, the lateral ends (43) and (44) of the pedal board housing (10), and function to provide structural support from vertical forces exerted against the upper panel of the housing. Each of the first and second side trusses (11) and (12) can comprise a plurality of incrementally dimensioned portals (16) therethrough.

Figure 2:
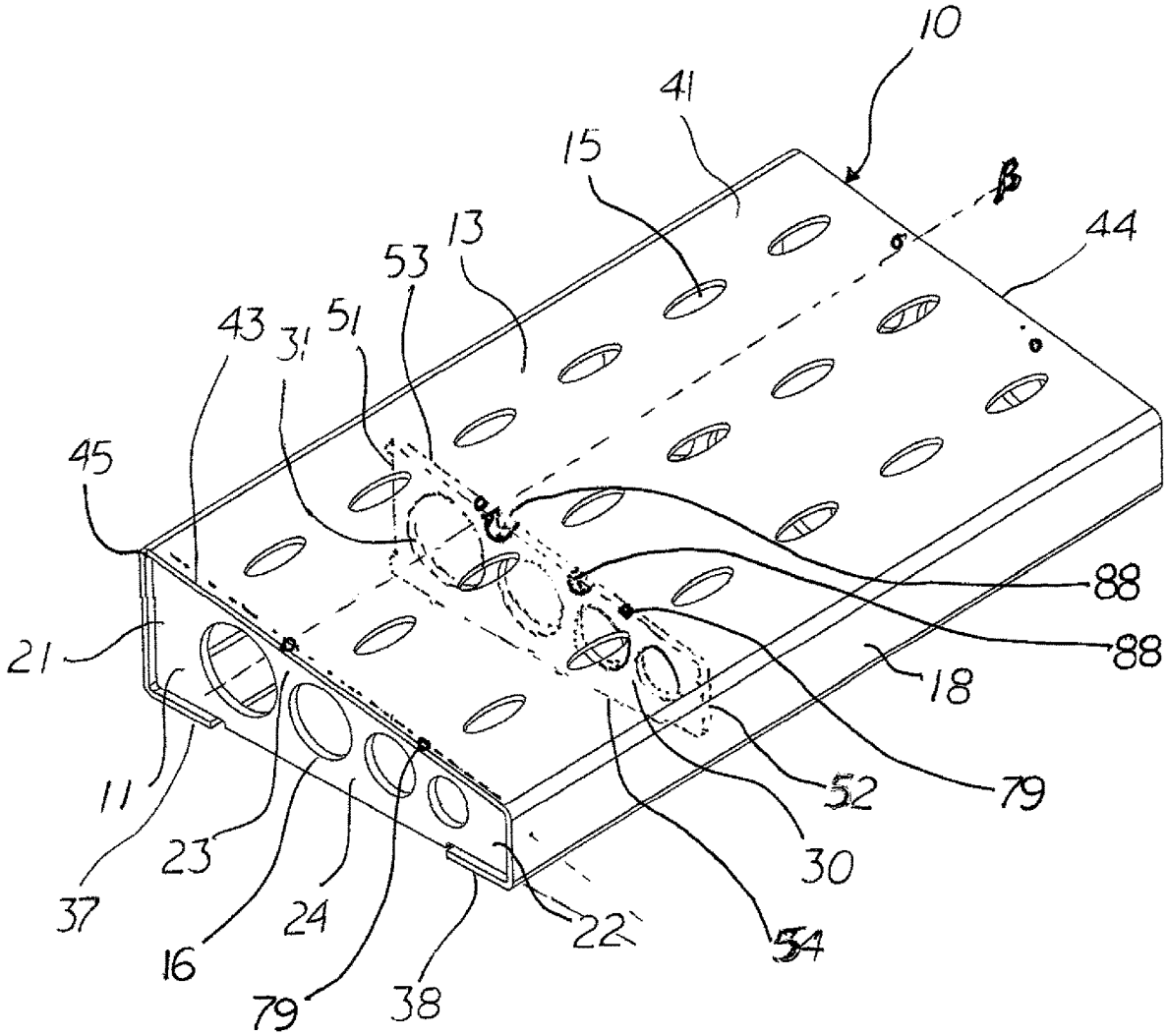
FIG. 2 is an angled side view of the pedal board showing the board housing and trusses according to one embodiment.
Figure 3:
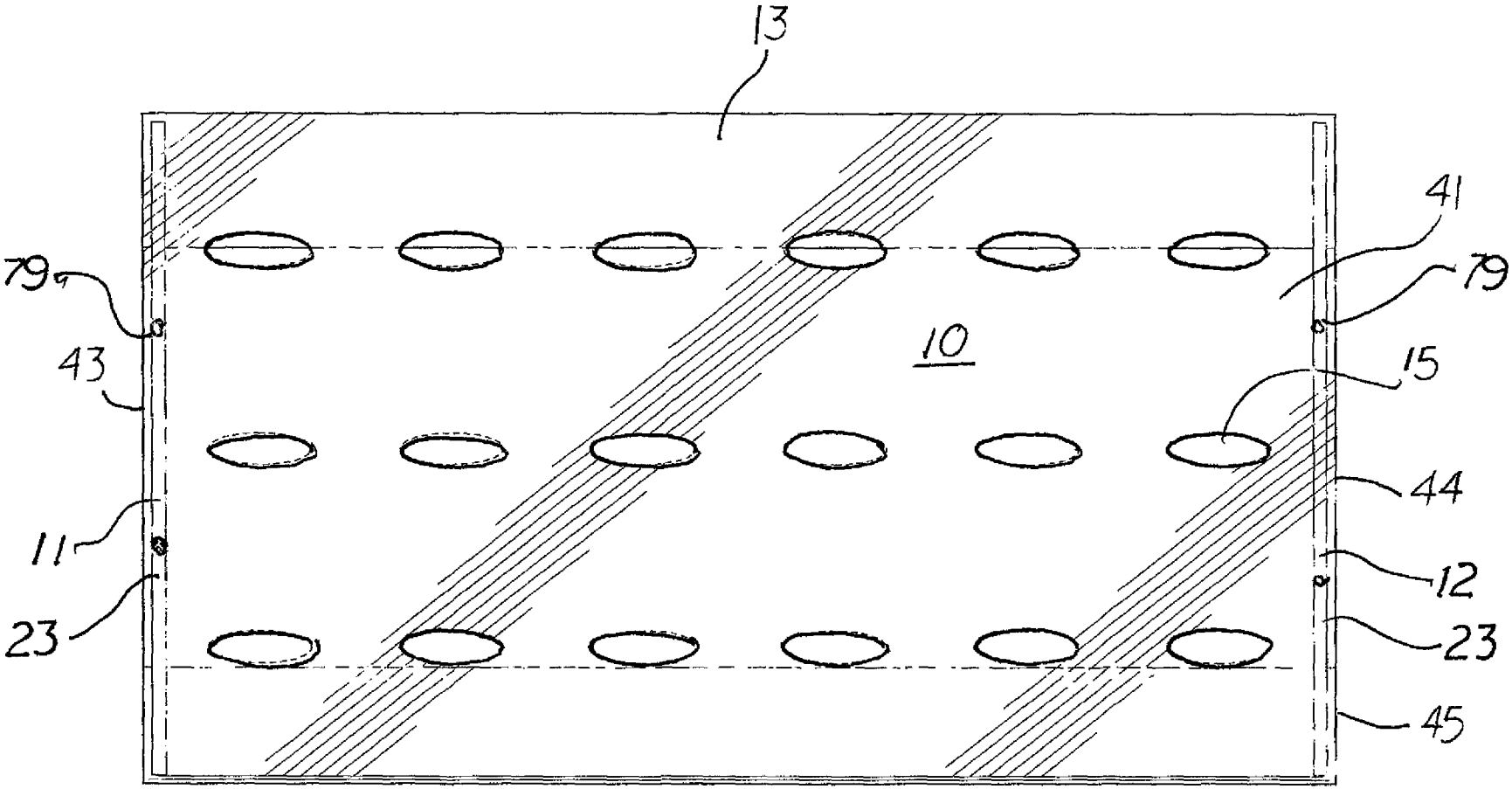
FIG. 3 is a transparent top view of the upper panel of the board housing, fenestrations and side trusses according to one embodiment.
Figure 9:
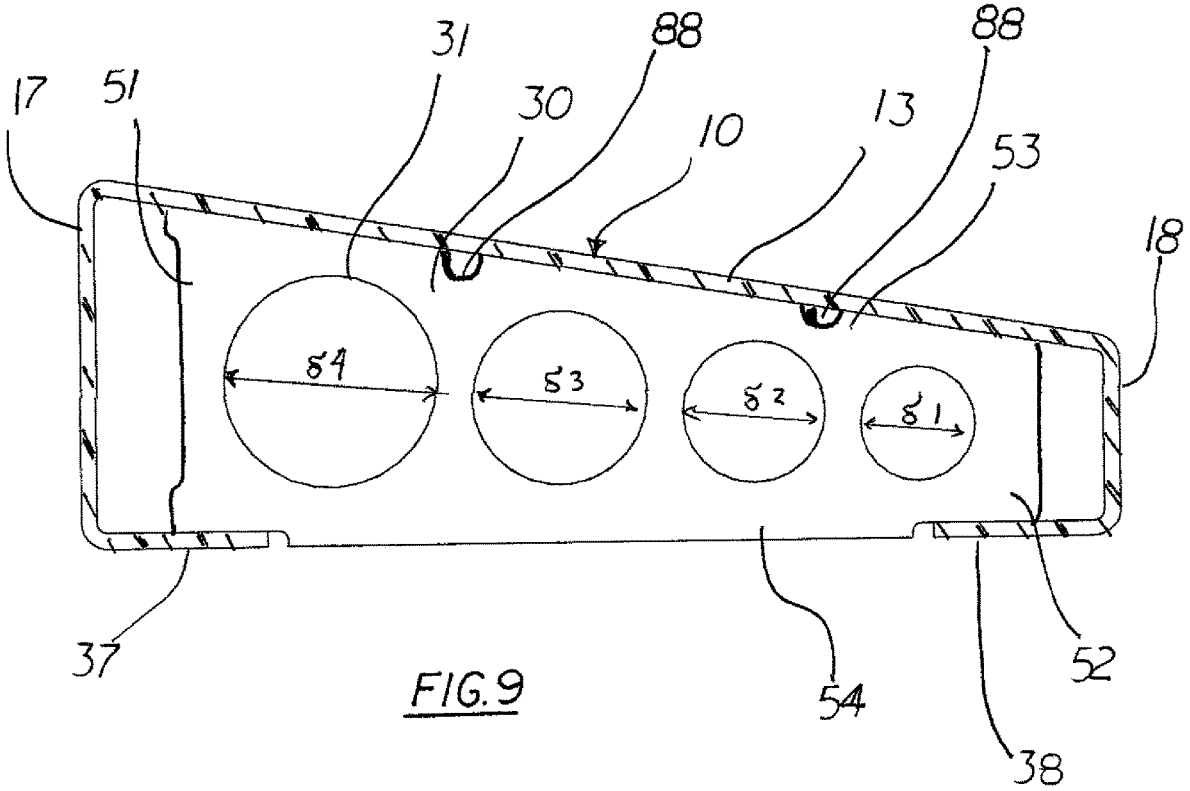
FIG. 9 is a left side cutaway view of a medial portion of the pedal board with interior support truss according to one embodiment.

In another embodiment, the pedal board of the invention can further comprise one or more supplemental support trusses (30) (see FIG. 9), also referred to herein as support trusses, positioned within the panel board housing (10) and between both of the side trusses (11) and (12). Each of the support trusses (30) can comprise a circumscribing perimeter having a front portion (51), rear portion (52), upper portion (53) and base portion (54), opposing first and second planar surfaces. The base portion (54) of the support trusses (30) can be structured to interfit and engage the interior surfaces (42) of the front panel base (37) and rear panel base (38) as shown in FIG. 9. Referring now to FIG. 2, when employed in the invention, the supplemental support truss (es) (30) can likewise comprise a plurality of incrementally dimensioned portals (31) therethrough in coordinated coaxial alignment 13 with the portals (16) of the side trusses (11) and 12. Referring to FIG. 9, in one embodiment, the support truss portals (31) can incrementally increase in width, circumference of diameter from the rear portion (52) toward the front portion (51) of the support truss (30).

The upper portion (53), lower portion (54), front portion (51) or rear portion (52) of the one or more support trusses (30) can further comprise one or more open channels (88) to form an opening through the support truss (30) from either side as shown in FIGS. 2 and 9. In addition to the support truss portals (31), the open channel (88) can further function to control and manage cords and wires and enhance separation thereof within the internal compartment of the pedal board.

A variety of truss structures and configurations, number and placement, are possible with the embodiments, provided that each truss, alone or in combination, functions to provide structural integrity to the pedal board housing, namely the upper panel (13) of the housing (10), and facilitates control and management of the equipment (e.g., devices, connectors, cords and wires) both as contained within the pedal board housing (10) interior compartment(s), as well as ingress and egress of the equipment connectors, cords and wires into and out of the pedal board. This multi-functionality can be accomplished by an overall truss structure which is generally planar, interfits within the interior surfaces (42) of the upper panel (13), front and rear panels (17) and (18), respectively, and the front and rear base (37) and (38), respectively, of the pedal board housing (10), and floor plate (70), if present, and which are non-obstructively positioned relative to the desired equipment. Support truss(es) (30) can be adjusted co-axially along the interior of the pedal board.

As depicted in the figures, the side trusses (11) and (12) can be dimensioned (e.g., length, height, thickness) so as to circumscribingly interfit with the interior perimeters of the panel board housing, whereas additional support truss(es) (30) need not be structurally co-extensive with the interior dimensions and interior (42) surfaces of the pedal board housing (10). This partial fit arrangement can be circumstantially preferable, especially when the pedal board system of the invention comprises an illumination system (described in greater detail herein below), which in one embodiment can be structured as an elongate LED bar running along, and continuously adjacent to, the interior surface of the front panel of the pedal board housing as shown in FIG. 22. Accordingly, the dimensions, i.e., length, height, thickness, of the side trusses (11) and (12) respectively and support truss(es) (30) can vary provided they can fit within the housing interior, non-interferingly coordinate with the fenestrations (15) of the upper panel (13) to be used, afford structural support to the pedal board housing (10), and permit passing through of connectors, cords and wires as desired.

Referring to FIG. 2, for example, the first and second side trusses (11) and (12), respectively, can be secured in place through the use of securing structures (79) fixing the upper portion (23) of the side trusses (11) and 12 onto the upper panel (13) of the housing (10). Likewise, securing structures (79) can affix internally positioned support trusses (30) through their corresponding upper portions (53). One or more securing structures (79) can be used for a given truss. A variety of suitable securing structures (79) can be used, including but not limited to, screws, pegs, and the like, provided undesired detachment or migration of the trusses is inhibited or prevented.

Furthermore, the side trusses (11) and (12) and support trusses (30) (when employed) can be integrally or contiguously molded along with the housing panels in embodiments whether or not a floor plate (70) is present, or, alternatively, attached at manufacturing stage or at time of use into the desired position. When trusses are structured for removable attached and re-positioning, the internal compartment is customizable according to the user's preferences. The side trusses (11) and (12), their upper portions (23) and lower portions (24), and any support truss(es) (30) and their upper portion(s) (53) and lower portion(s) (54) can be constructed with an incline angle configuration that parallels and cooperates with that of the upper panel (13) and floor contacting region of the pedal board housing (10), so as to provide continuous vertical structural support to the upper panel (13) of the pedal board housing (10), as shown in the figures.

In a preferred embodiment and as shown in the figures, the dimensions of the portals can incrementally increase in cooperation with the increasing vertical height of the truss, which in turn, cooperate with the increasing height of the inclined pedal board housing. The total number of portals can vary according to anticipated need and preference. For example, each truss can have 2 to 8 portals, if desired. For purposes of illustration, the pedal board of the embodiments is depicted throughout the figures with trusses having four circular portals in linear and sequential incremental increasing diameters (represented as Greek symbol delta δ), whereby d4>d3>d2>d1 (see FIGS. 7, 8 and 9).

Figure 24:
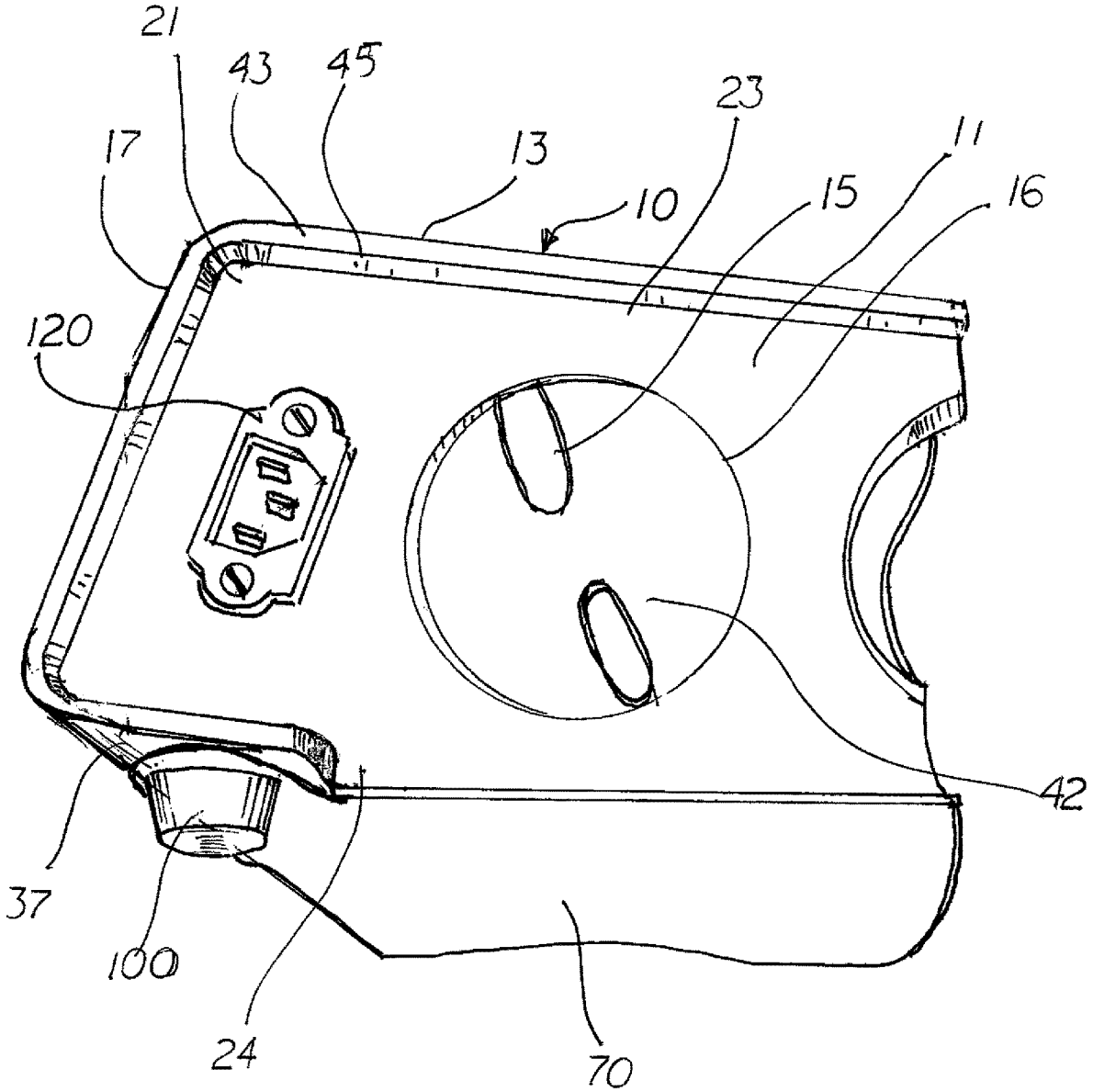
FIG. 24 is an angled side view of a portion of a side truss having an integrated connector according to one embodiment.

The first side truss (11), the second side truss (12), or both, can further comprise integrated junctures (120) for receiving corresponding connectors. For example, a three-pronged electrical juncture (120) is depicted in FIG. 24. Accordingly, the side trusses (11) and (12) can be structurally modified at manufacturing stage in accordance with the desired features of the pedal board. This structural feature of the invention can further simplify and manage internally-located connectors and cords within the interior compartment of the pedal board.

Aside from the total number of trusses, truss portal shape and dimensions can vary provided the support function and management functions of the trusses are preserved. Although shown in the figures as circular with incremental diameters, the portals (16) and (31) can be square, rectangular, ovoid, triangular, polygonal, amoeboid, and the like. Furthermore, the truss portals need not be in sequential or linear alignment.

Cover

Referring now to FIGS. 12 through 19 and 26, the pedal board of the embodiments can comprise a semi-rigid flexible single-piece construction pedal device cover (14) for engagement with the panel board housing upper panel (13) and through its fenestrations (15). The pedal device cover (14) can have a generally arcuate body comprising an upper portion (141) contiguous with a pair of opposing first and second side portions (142) and (143), respectively, an exterior surface (145) and interior surface (144), and have an open front end (146) and rear end (147). The pedal device cover (14) can be constructed as a single-piece contiguous arcuate body configuration composed of flexible material and having squared edges between the upper portion (141) and first and second side portions (142) and (143), respectively.

A variety of suitable overall configurations are possible, provided the protective functionality of the cover (14) for the devices positioned therein is present, as well as unobstructed manual and podiatric access to the devices placed thereunder. Accordingly, the dimensions (i.e., height, width, depth) can also vary provided the cover (14) can accommodate a pedal device (90) within and still contact and engage the upper panel (13) and fenestrations (15) of the pedal board housing (10). As shown in the figures, the front end (146) and rear end (147) of the cover (14) can be configured to lean forward (relative to the pedal board) in a parallel manner so as to be less obstructive to podiatric operation of the pedal device (90). A plurality of pedal device covers (14) can be used with the pedal board, and the quantity of covers (14) can vary along with the number of pedal devices (90) or other coverable devices to be used simultaneously on the pedal board.

The pedal device cover (14) can further comprise a pair of opposing first and second flanges (148) and (149), respectively, wherein the first flange (148) extends outward from the bottom of the first side portion (142) and the second flange (149) extends outward from the bottom of the second side portion (143). An important feature of the invention is that each of the first and second flanges (148) and (149), respectively, comprise a mechanical coupling structure (60) for cooperative and removable coordinated engagement with the upper panel (13) and fenestrations (15) of the pedal device board housing (10).

Figure 26:
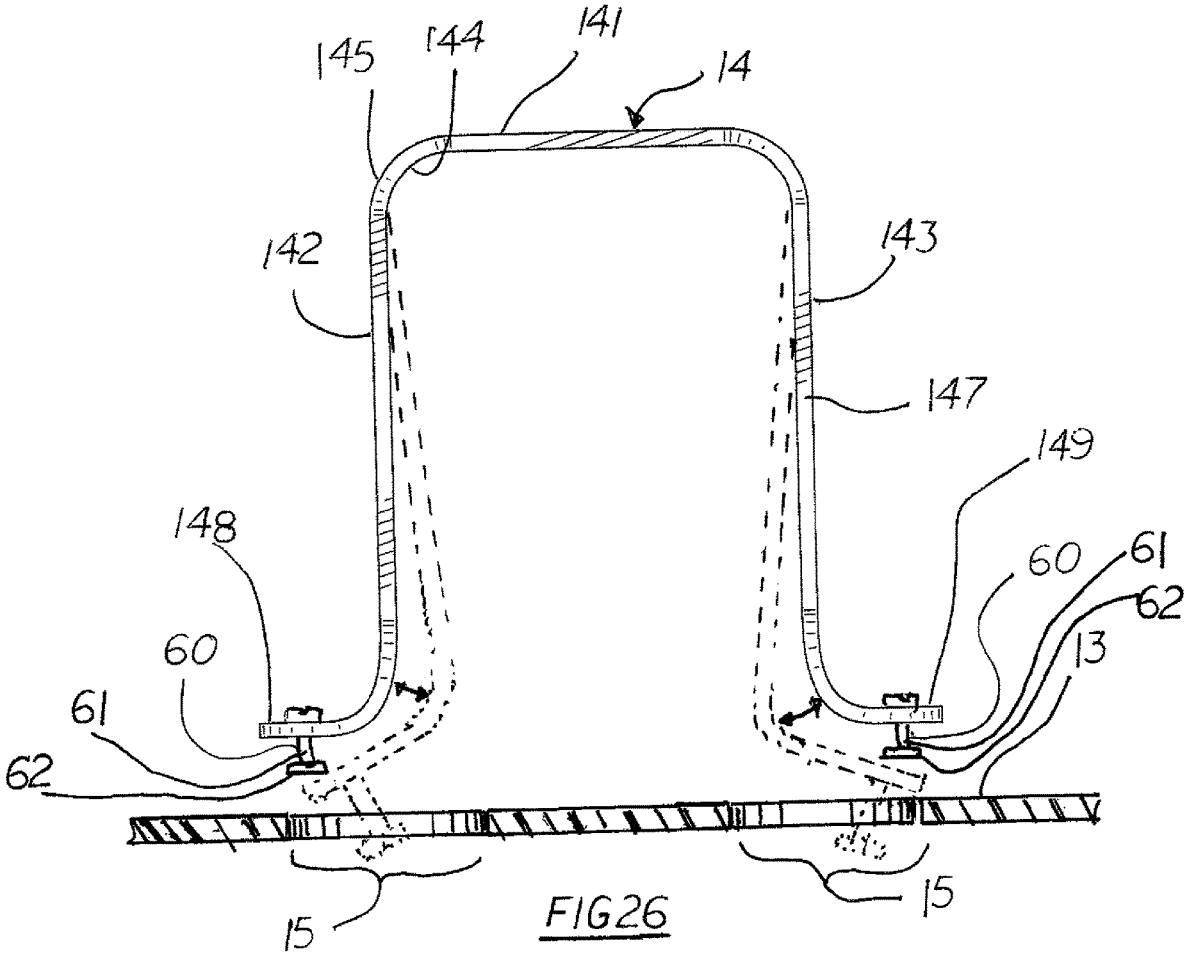
FIG. 26 is a schematic diagram of an end view of pedal device cover having mechanical coupling structures above a cutaway view of a portion of a upper panel and pair of fenestrations showing inward flexing of the cover sides and illustrating engagement according to one embodiment.

Although a variety of materials can be used for the cover (14), preferably the pedal device cover (14) is composed of a semi-rigid flexible material to permit tension-fit engagement of the first and second flanges (148) and (149) and the mechanical coupling structure (60) onto the upper panel (13) of the board housing (10). Referring now to FIG. 26, the pedal device cover (14) can be squeezed by applying inward force against the exterior of the first side portion (148) and second side portion (149) toward each other during positioning, and subsequently released to resting state by releasing the force and allowing outward expansion of the first and second side portions (148) and (149). This two-step action permits the mechanical coupling structure (60) to become inserted into the aligned pairings of fenestrations (15) and then produce coordinated outward tension against the portion of the housing (10) within opposing fenestrations (15) adjacent to the flanges (148) and (149) of the cover (14) and pedal device housing (10). The accessibility and viewability of the pedal devices (90) when placed under the pedal device cover (14) (see FIG. 1) by way of the open front end (146) and rear end (147) and transparent material facilitates accurate positioning and re-positioning of the cover (14) on the upper panel (13) of the pedal board housing (10), as well as connectivity of the connectors and cords to and from (i.e., input and output) for the pedal device (90).

Figure 18:
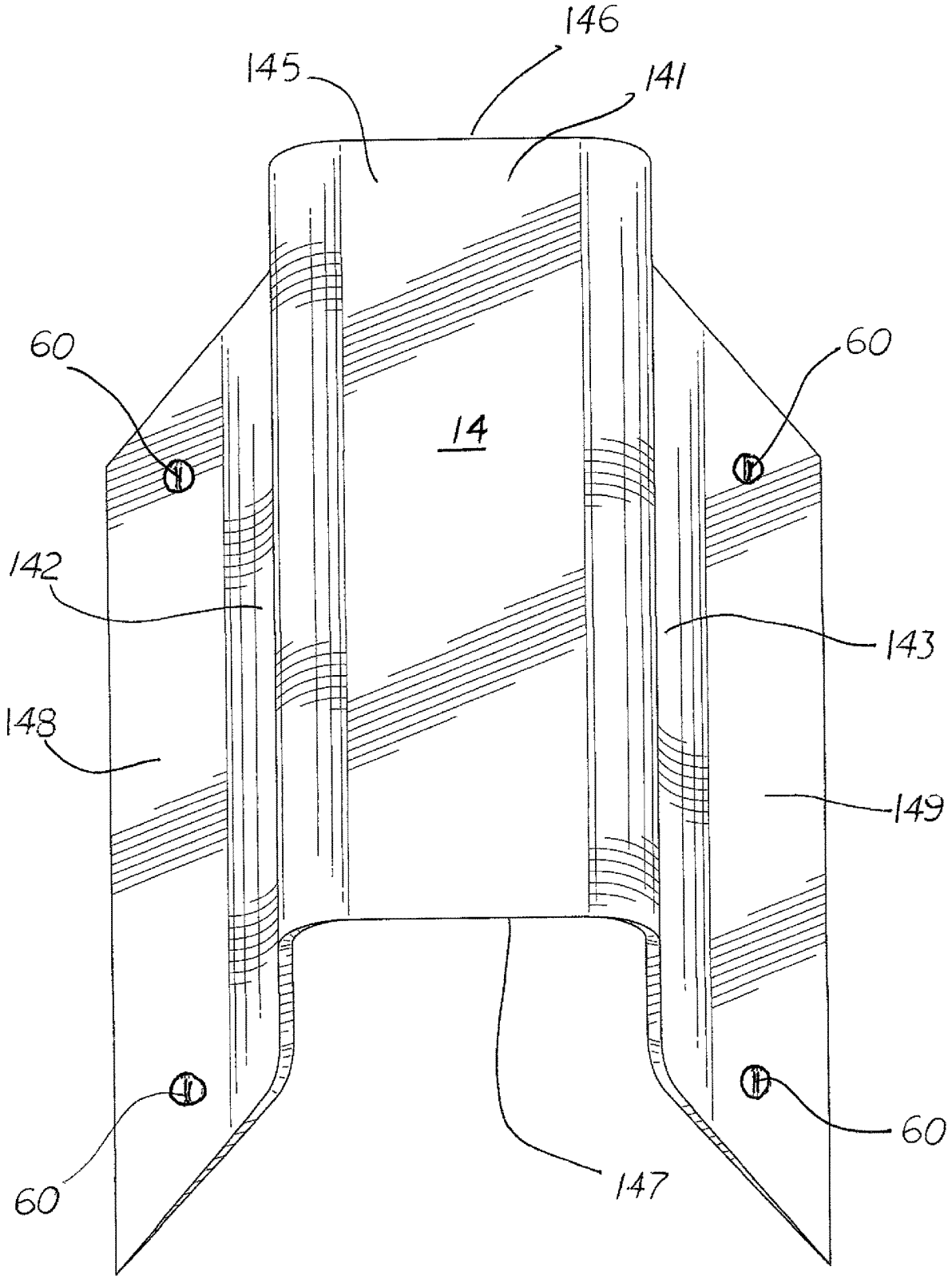
FIG. 18 is a top view of the pedal device cover with raised flange configuration according to one embodiment.
Figure 19:
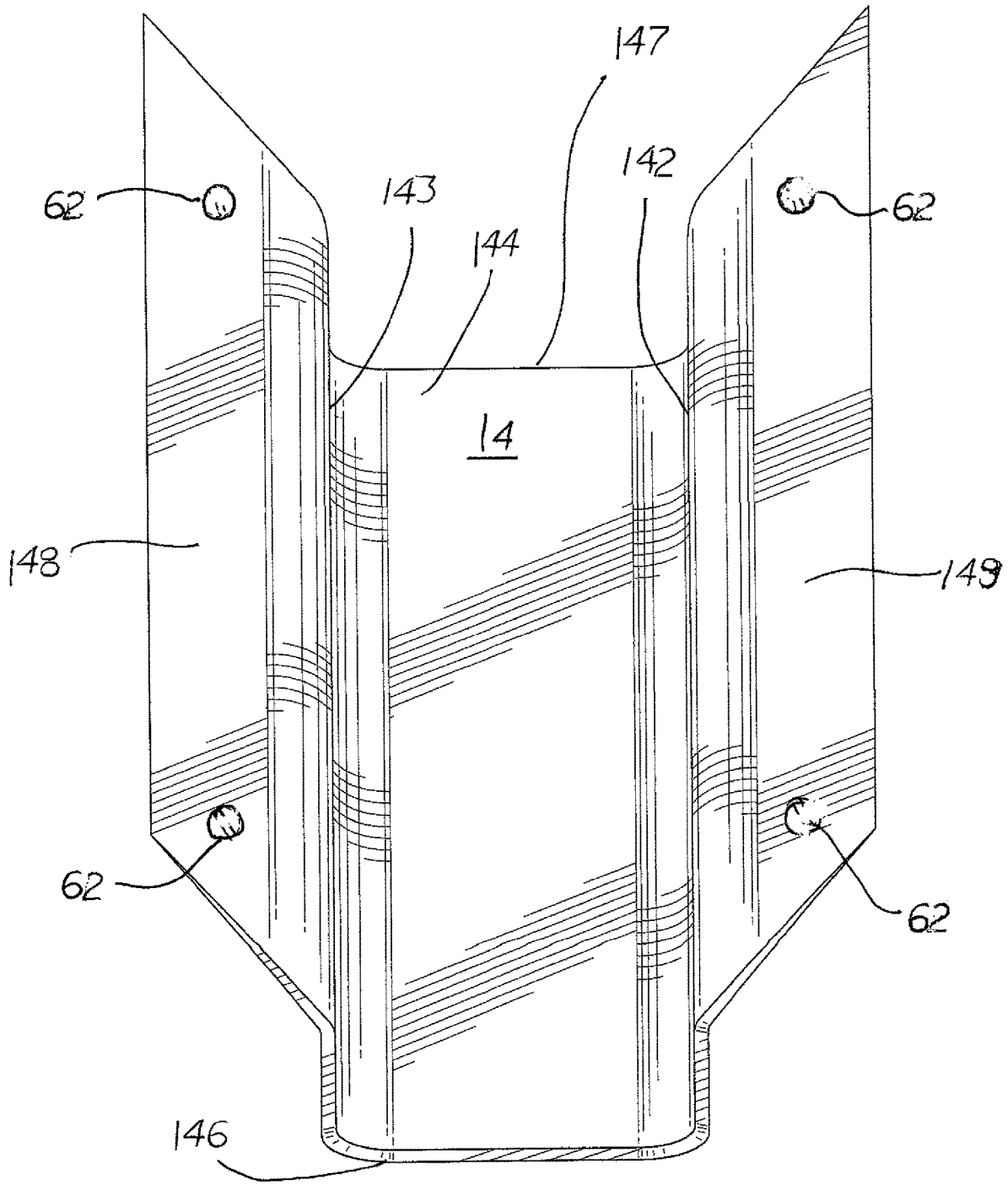
FIG. 19 is bottom view of the pedal device cover with raised flange configuration according to one embodiment.

The pedal device cover (14) configuration can vary to some extent while preserving the mechanical and functional attributes. For instance, the pedal device cover (14) can comprise a flush flange embodiment (as shown in FIGS. 1 through 17) and raised flange (as shown in FIGS. 18 and 19) embodiment as shown in the figures—each comprising a mechanical coupling structure (60) for securement of the cover (14) to the upper panel (13) of the pedal board housing (10).

Mechanical Coupling Structure

The pedal device cover (14) can be secured to the upper panel (13) and fenestrations (15) through a mechanical coupling structure (60) located at the first and second flanges (148) and (149) of the pedal device cover (14). A variety of suitable mechanical coupling structures (60) can be used provided they function to a) cooperatively engage the fenestrations (15) and maintain its structural integrity by withstanding the outward directed tension forces exerted by the pedal device cover (14) in resting state and forces associated with the operation of the pedal device (90) housed under the cover (14) on the pedal board, and b) simultaneously securely joining the cover (14) to the upper panel (13) inhibiting its unintentional or undesirable horizontal or vertical migration. Suitable mechanical coupling structures (60) can be composed of any material capable of withstanding the expected forces exerted on the pedal board in use. Examples of suitable materials include, but are not limited to, metals, metallic alloys, plastics and polymeric materials, and the like. Furthermore, the mechanical coupling structure (60) can be constructed as a removable or fixedly attached structure on the first and second flanges (148) and (149), respectively. Alternatively, the mechanical coupling structure (60) can be fixedly attached at manufacturing stage, such as a collared rivet, or can be integrally molded or formed structure extending downward on the underside of the first and second flanges (148) and (149). Such structures can be in the form of posts, tabs, and the like.

Referring now to FIGS. 12 through 19, the mechanical coupling structure (60) is illustrated as a downward extending post (61) having a collar (62) attached to the cover (14) through two opposing pairs of holes (not shown) on the first and second flanges (148) and (149). The length of the post (61) between the underside of the flanges (148) and (149) and the collar (62) can be approximately the same as the thickness of the upper panel (13) so that the collar (62) can reach the underside of the upper panel (13) circumscribing the fenestrations (15).

Referring now to FIG. 1 and FIG. 26, the mechanical coupling structure (60) can be secured onto the upper panel (13) of the housing (10) by aligning two opposing pairs of mechanical coupling structures (60) with corresponding opposing pairs of fenestrations (15), squeezing the first and second side portions (142) and (143) of the cover (14), placing the first and second flanges (148) and (149) against the upper panel (13) inserting the mechanical coupling structure (60) into the aligned fenestrations (15), and releasing the tension of the cover (14) thereby allowing the cover (14) to return to its resting state, thereby creating a tension fit of the cover (14) onto the housing (10). To remove the cover (14) from the housing (10), the cover (14) can be squeezed again inward and lifted upward from the upper panel (13). This arrangement permits facilitates arrangement and re-arrangement of one or more covers (14) on the pedal board thereby affording a variety of customizable options for the user.

Illumination Display

The embodiments further provides a pedal board system comprising the pedal board in combination with an illumination display device (110) that cooperatively utilizes the pedal device board material(s) for visual effect, such as the transparency or semi-transparency of the material of the front panel (17) of the pedal board housing (10). A suitable light source can include, but is not limited to, incandescent, halogen, neon, fiber optic or LED technologies. Suitable LED light sources include commercially available LED light bars and light strips and associated electrical connections, such those available under brand names DAYBETTER, MINGER, LDOPTO, ANBOCK, SZOKLED, KC® HiLITES, for example, and can be electrically coupled (as illustrated in FIG. 22, or remote controlled battery operated LED light bars and strips.

In one embodiment and as shown in FIG. 22 and FIG. 25, the pedal board system can include an illumination display device (110) comprising an elongate linear LED light bar substantially co-extensive in length to the front panel (17) of the pedal board housing (10), wherein the LED light bar comprises an LED light source (111) adjacent to a diffuser (112) positioned to transmit light through a front image filter (113) (see FIG. 25), and electrical power source (114). When illuminated, the LED light bar transmits light through image filter (113) to project an image (115) on the front panel (17) and externally viewable when viewing the front of the pedal board. The LED light bar can illuminate in monochromatic, multi-color, color-changing options using conventional and readily available LED technology available to those skilled in the art.

When positioned within the pedal board, the illumination display device (110) can be positioned adjacent the interior surface (42) of the front panel (17) of the pedal board housing (10). The illumination display device (110) is preferably located within the housing (10) so as to function for projection without intervening interference from internal equipment within the pedal board between the light source (111) and the projected image (115).

The illumination display device (110) can be dimensioned for internal placement within the pedal board internal compartment and can be secured into place using a variety of fixation means, such as tabs, brackets, magnetic coupling, adhesives, and the like. In one embodiment, the illumination display device (110) can be attached to the front portion (51) of one or more support trusses (30) to hold the illumination display device (110) at a location spaced apart from the interior surface (42) of the front panel (17) of the housing (10). The power source can be an internal or self-contained source, such as a battery, or an external source such as by electrical cord and connector (114) (as shown in FIG. 22), or otherwise operable with the specific light source technology employed in the invention.

In accordance with the embodiments, the illumination display device (110) functions in cooperation with the front panel material and remaining pedal board housing material to provide an illuminated display that is externally viewable from the front of the pedal board, and in one embodiment through the top and back of the pedal board. The material itself can be modified or treated to selectively transmit light to form an image. Accordingly, the image can be formed by projection through an image filter (113) directly on a diffuser (112) of a light source (111), an image filter (113) affixed to the interior surface (42) of the front panel (17) of the housing (10), or a combination of both such illumination imaging arrangements. A wide variety of image projection configurations are possible.

A variety of conventional techniques can be used to modify the interior and exterior surfaces (42) and (41) of the housing material to partake in image creation. For example, transparent and semi-transparent materials can be modified for creating images using conventional methods, including but not limited to texturing, filters, transparencies, frosting, etching, masking, painting, printing, engraving, and the like. The desired illuminated image can be projected by contrasting opaque, semi-transparent, translucent or distorted positive or negative images. A wide variety of images can be selected by the user, such as logos, band names, product names, promotional messages, icons, words, phrases, artistic designs, and the like.

Materials & Manufacture

An important aspect of the embodiments is the material used to construct the pedal board housing (10). In general, the material used to construct the pedal board and its components can have mechanical integrity to withstand the foreseeable forces exerted upon it in use. Suitable rigid and semi-rigid and flexible materials which are conventional and readily available to those skilled in the manufacturing field that can be used include to make the pedal board include, but are not limited to, metals, metallic alloys, plastics and polymeric materials, fiberglass, and the like, and composites thereof.

The combination of functional advantages and benefits associated with the embodiments are further associated with, and best realized from, the utilization of particular material properties in addition to mere structural integrity. In a preferred embodiment, the material of the pedal board housing (10) possesses transparent or semi-transparent properties so as to a) permit external visibility of interior components and equipment within the pedal board, and b) interaction with and externally visible transmission of light from a light source placed within the pedal board for illumination display. Materials which facilitate the cost-effective and lightweight manufacture of the pedal board housing and pedal device covers include those which permit single-piece construction formed from transparent thermoplastic materials.

Suitable transparent and optically refractive thermoplastic polymers that are readily available to those skilled in the plastics manufacturing field and that can be used to manufacture the pedal board housing and pedal device cover include, but are not limited to, polycarbonate, polymethylmethacrylate (PMMA) and acrylic, polyethylene terephthalate (PET), amorphous copolyester (PETG), polyvinyl chloride (PVC), liquid silicone rubber (LSR), cyclic olefin copolymers (COC), polyethylene (PE), ionomer resin, transparent polypropylene (PP), fluorinated ethylene propylene (FEP), styrene methyl methacrylate (SMMA), styrene acrylonitrile resin (SAN), polystyrene general purpose (GPPS), transparent ABS (MABS), and the like. With respect to the pedal device cover, the pedal device cover material can be a semi-rigid material that permits some extent of reversible flexing properties in order to partake in the tension fit functionality of the cover.

Although preferably the pedal board housing and cover can be composed of transparent or semi-transparent material, the remaining components of the pedal board assembly can be made from the same or different materials from that used for the housing. The side trusses and support trusses, for instance, can be made from either transparent plastic or opaque plastic, fiberglass, metal, metallic alloys, and the like, and composites thereof, and can possess rigid properties.

Some or all of the plastics and polymeric materials used to make the components of the pedal board of the invention can comprise suitable coloring agents and pigments. Coloring agents and pigments can further be selected and used for the desired illuminated display image and overall appearance of the pedal board. Suitable plastic and polymeric coloring agents, pigments, and tinting that can be used with the selected materials are readily available to those skilled in the plastic manufacturing field.

Usage

When employing the pedal board and system to perform music using an electric guitar, the user initially selects one or more of the desired effect pedals. The effect pedals are then arranged and positioned upon the upper panel of the panel board. Input and output connectors and cords can be coupled to the associated pedal device, power supply, illumination system, and the like in accordance with the selected equipment to be employed. FIGS. 1, 20 and 21 illustrate examples of set-up of the pedal board of the invention and associated equipment and devices. The desired equipment and devices can be assembled, together with the electronic musical instrument, e.g., electric guitar (not shown) alongside the pedal board. Devices and equipment for placement within the interior compartment of the housing (10), such as power boxes from an external power source, can be positioned inside the housing (10) underneath the fenestration(s) (15) near the intended device location to which they are to be connected to reside on the upper panel (13) of the pedal board housing (10). The connectors and cords of the underside devices can be arranged and passed through the side truss portals (16), interior support truss portals (31) and open channels (88), and egress through the fenestrations (15) of the upper panel (13) so as to be accessible on top of the pedal board and connectable to devices to be located on the upper panel (13). The devices to be placed on top of the pedal board, e.g., pedal devices (90), and the like, can be positioned between two opposing pairs of fenestrations (15) (see FIGS. 1 and 21, for example)

and the associated input and output connectors can be inserted into the receptacles (not shown) on the device (90). Cords that are to become reinserted through fenestrations (15) can be passed through the same back into the interior compartment of the pedal board, and cords and connectors to be placed on the exterior of the upper panel (13) for further connection can be arranged accordingly.

Referring to FIG. 1, a cover (14) can then be placed over the device (90) and equipment to be covered can be positioned over the device (90) and the mechanical coupling structures (60) can be inserted through the opposing pairs of fenestrations (15) and the cover (14) secured by tension fit as described herein above and as shown in FIG. 26. The cover (14) should be oriented such that the open rear end (147) of the cover (14) affords the necessary access form the rear of the pedal board by the user as shown in FIG. 1. As shown in FIG. 1, the input cord can be inserted through a side truss portal (16) and into the interior compartment and support truss portal (31) and up through a fenestration (15) and egress adjacent to the device (90) on the upper panel (13) and coupled therewith in a cord and connector arrangement that will not interfere with the cover (14) when placed over the device (90) as shown in FIG. 21. Additional cords connected to the device (90) can optionally remain above the upper panel (13) on the exterior surface (41) of the housing (10) as shown. In a similar manner, the user can continue to arrange devices and equipment, or re-arrange and customize the devices and equipment both within the interior compartment of the pedal board or above to suit preferences.

The pedal board by virtue of the combination of its structural and functional features and materials affords the user rapid on-site arrangement and organized assembly of pedal devices and other equipment, such as power boxes, for example. Additionally, the pedal board and system permit advanced assembly of the pedal devices and equipment capable of transport with a reduced likelihood of disassembly and disheveling of the pedal devices and equipment when the pedal device covers are secured over the pedal devices onto the pedal board. The user can also pre-connect the various pedal devices and equipment to facilitate on-site set-up. When constructed using lightweight, transparent or semi-transparent materials, the pedal board and system of the embodiments can be easily transported, is visually appealing, affords internal visibility of associated equipment, and cost-effective and easy to assemble and manufacture. By virtue of its structural and functional features, the pedal board and system of the embodiments further provides ready and rapid arrangement and wide range of customizable options for equipment, cords and wires through fenestrations and truss portals inside the pedal board, and accordingly, affords improved control and management of cords and wires associated with equipment, such as making adjustments of input and output connections, and the like. When used in conjunction with a transparent or semi-transparent pedal device cover, the user can easily view and access one or more pedal devices while at the same time protecting or minimizing the risk of unintentional contact or damage of the pedal devices (controls, wiring, knobs, and the like), avoidance of accidental disconnection of cords and wires from the pedal device, and undesired migration of the pedal devices on the pedal board during use (e.g., musical performance). In addition to affording view of the interior of the pedal board with transparent or semi-transparent materials, when used in combination with an illumination display system, the embodiments offers a variety of attractive and visually appealing display illumination possibilities and design, such as brand names, logos, messages, and the like.

The embodiments herein above have been described with reference to various and specific techniques. The embodiments have been described within the context of sound effect pedal equipment used in conjunction with electronic string instruments. For example, the objects, advantages and features of the pedal board and pedal board system of the embodiments can be realized when employed with electric guitars, although it is possible to utilize the invention with other electronic musical instruments, such as an electric violin. It will be understood by one skilled in the art that reasonable variations and modifications can be made without substantially departing from the spirit or scope of the embodiments as defined by the following claims.

What is claimed is:

1. A pedal board for use with electronic instrument output sound equipment comprising:

a generally planar contiguous single-piece pedal board housing having a horizontal upper panel, opposing vertical front panel and vertical rear panel, and having an exterior surface and interior surface, and a pair of opposing first and second lateral ends, and a contiguous board edge running along the outer perimeter of the board housing in continuity with the panels;

wherein the upper panel comprises a plurality of fenestrations;

a pair of opposing first and second vertical planar side trusses, each of the first side truss and second side truss having a circumscribing perimeter, and opposing first and second planar exterior surfaces;

wherein the first planar side truss is attached to the first lateral end of the housing, and the second planar truss is attached to the second lateral end of the housing;

a semi-rigid single-piece pedal device cover for engagement with the panel board housing upper panel through the fenestrations, the pedal device cover having a generally arcuate body comprising an upper portion contiguous with a pair of opposing first and second side portions, and an exterior surface and interior surface, and having open front end and open rear end;

wherein the pedal device cover further comprises a pair of opposing first and second flanges, wherein the first flange extends outward from the bottom of the first side portion and the second flange extends outward from the bottom of the second side portion; each of the first and second flanges comprising a mechanical coupling structure for cooperative removable engagement with the upper panel of the pedal device board housing; and the pedal device cover is composed of a semi-rigid flexible material permitting tension-fit engagement of the mechanical coupling structure of the first and second flanges and fixation onto the upper board housing panel.

2. The pedal board according to claim 1, wherein each of the side trusses comprises a plurality of incrementally dimensioned portals therethrough.

3. The pedal board according to claim 2, wherein the portals of the side trusses are in co-axial alignment through each end of the pedal board housing.

4. The pedal board according to claim 2, wherein the side trusses comprise portals incrementally increase in size from the rear edge of the truss toward the front edge of the truss in coordination with a corresponding upper panel incline angle.

5. The pedal board according to claim 1, wherein the pedal board housing is formed from a single-piece thermoplastic material.

6. The pedal board according to claim 5, wherein the thermoplastic material is composed of a transparent material.

7. The pedal board according to claim 5, wherein the thermoplastic material is composed of a semi-transparent material.

8. The pedal board according to claim 1, wherein the pedal board housing is constructed to have an upper panel which is inclined or tilted as formed by diverging and converging angles created by a front panel greater in height than a rear panel.

9. The pedal board according to claim 1, further comprising a floor plate attached to the base of the pedal board housing.

10. The pedal board according to claim 1, further comprising an interior support truss medially positioned within the housing between both of the side trusses.

11. The pedal board according to claim 10, wherein the support truss further comprises a plurality of incrementally dimensioned portals therethrough in co-axial alignment with the portals of the side trusses.

12. The pedal board according to claim 10, wherein the support truss portals incrementally increase in size from the rear edge of the truss toward the front edge of the truss in coordination with a corresponding upper panel incline angle.

* * * * *